United States Patent [19]

Seidl et al.

[11] 4,027,590

[45] June 7, 1977

[54] LABEL, TICKET AND TAG PRINTING MACHINE WITH INTERCHANGEABLE TAPE SUPPLY AND FEEDER MAGAZINES

[75] Inventors: Maximilian R. Seidl, Munich; Joachim Seidl, Eching, both of Germany; Walton M. Henry, Rydal, Pa.

[73] Assignee: Avery International Corporation, San Marino, Calif.

[22] Filed: Mar. 5, 1975

[21] Appl. No.: 555,343

Related U.S. Application Data

[62] Division of Ser. No. 377,830, July 9, 1973, Pat. No. 3,908,544.

[52] U.S. Cl. ..... 101/288; 226/137; 197/133 R; 101/228

[51] Int. Cl.[2] ..... B41F 13/64

[58] Field of Search ..... 101/228, 231, 227, 287, 101/288, 292, 66–67, 68, 69; 226/137, 19, 141, 117, 191; 197/127 R, 130, 133 R

[56] References Cited

UNITED STATES PATENTS

| | | | |
|---|---|---|---|
| 1,965,578 | 7/1934 | Colquhoun | 101/288 |
| 2,020,124 | 11/1935 | Rosenthal | 101/292 |
| 2,638,038 | 5/1953 | Marsh et al. | 101/288 X |
| 2,824,736 | 2/1958 | Allen | 271/2.6 |
| 3,256,813 | 6/1966 | Casey | 101/292 |
| 3,294,212 | 12/1966 | Gearheart et al. | 197/133 R |
| 3,331,315 | 7/1967 | Henry | 101/66 |
| 3,401,630 | 9/1968 | Goodrich et al. | 101/228 |
| 3,485,335 | 12/1969 | McMahon | 197/6.7 |
| 3,601,042 | 8/1971 | Hamisch | 101/69 |
| 3,767,098 | 10/1973 | Pabodie | 226/117 |

FOREIGN PATENTS OR APPLICATIONS

| | | | |
|---|---|---|---|
| 136,043 | 12/1933 | Austria | 101/66 |
| 1,249,010 | 10/1971 | United Kingdom | 101/66 |
| 333,579 | 8/1930 | United Kingdom | 101/66 |

*Primary Examiner*—Edward M. Coven
*Attorney, Agent, or Firm*—Leonard L. Kalish

[57] ABSTRACT

A label, ticket and tag printing and dispensing machine with readily detachable and attachable interchangeable tape supply and feeding magazines, for the optional and selective use of any one of several alternative pre-adjusted tape-feeding magazines, each loaded with a roll of a different size or kind of labels, tickets or tags, thereby to provide maximum and ready variability and range of tape-supply; with each of the several alternative magazines being individually pre-adjusted for the length and width and other characteristics of the label, ticket or tag and in relation to location of the print-impression of the printer. Each magazine holds a roll of labels, tickets or tags and includes a self-contained tape-feeder for intermittently feeding the tape from the roll in the magazine in label, ticket or tag lengths in timed relation to the printing sequence of the printer portion. The printer portion includes a tape-feeder cam or several alternative tape-feeder cams. The tape-feeder (forming a part of the magazine portion) has a cam-follower extending from the feeder-slide thereof into operative juxtaposition to the feeder-cam in the printer portion when the magazine portion is operatively connected with the printer portion.

12 Claims, 41 Drawing Figures

Fig. 13.A

Fig. 17.
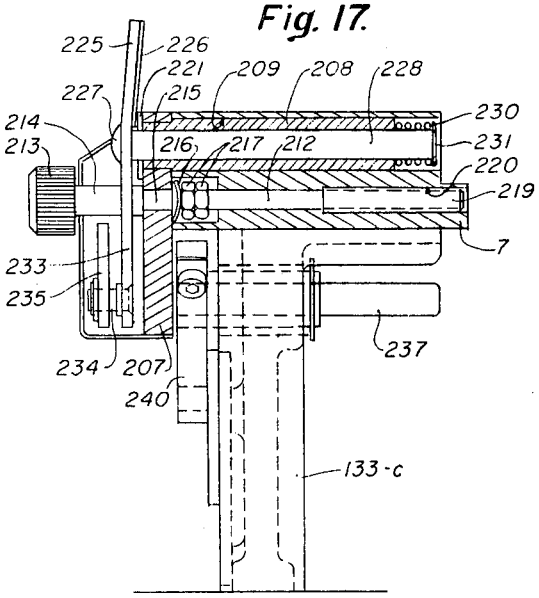
Fig. 16.
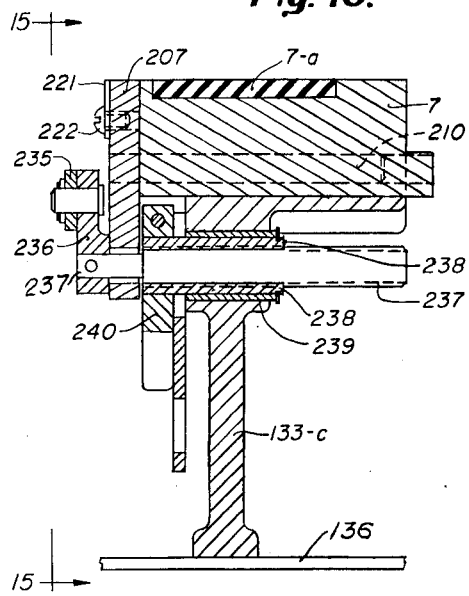
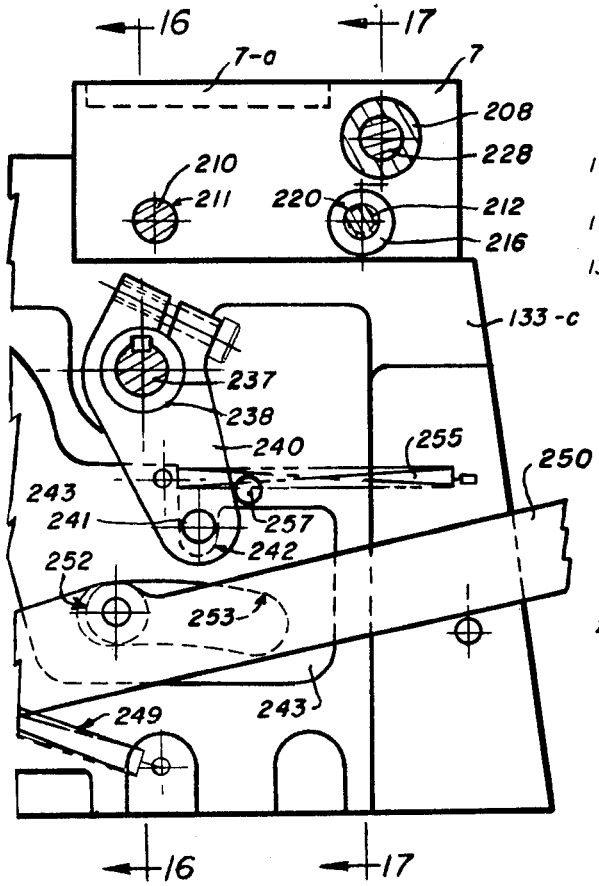
Fig. 15.
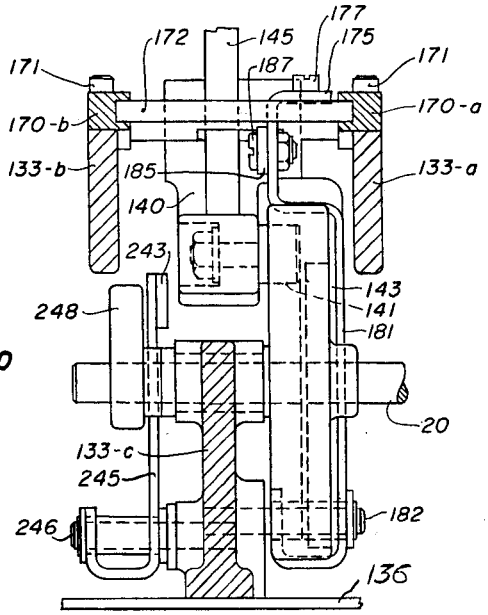
Fig. 18.

Fig 32.
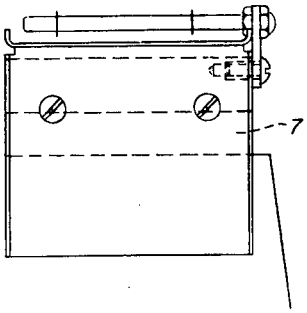
Fig. 31.
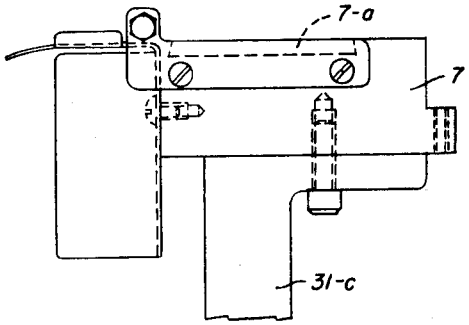
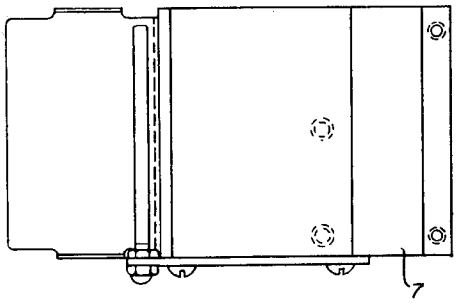
Fig. 33.
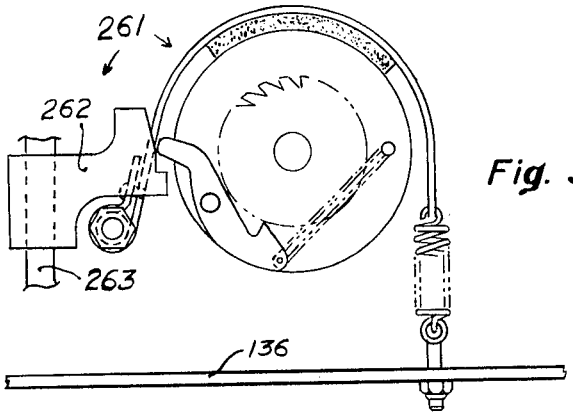
Fig. 37.

LABEL, TICKET AND TAG PRINTING MACHINE WITH INTERCHANGEABLE TAPE SUPPLY AND FEEDER MAGAZINES

This is a division of application Ser. No. 377,830 filed July 9, 1973, now U.S. Pat. No. 3,908,544.

BRIEF SUMMARY AND OBJECTS OF THE INVENTION

In heretofore conventional label, ticket and tag printing and dispensing machines it is necessary to re-set the machine everytime a different length or width or kind of label, ticket or tag is to be printed, so as to accomodate the machine for the length and width of the label, ticket or tag and for any preprinted text thereon, and also for other variations, such as whether the tape is notched along its edge or edges or whether it has feed-openings midway of its width or whether tape has tag-strings or is without strings, and so on. The machine may also have to be re-adjusted or re-set for different size labels, tickets or tags with different pre-printing thereon, so as to locate the tape in relation to the type-chase or in relation to a band-printer-head or other printing elements, so that the imprinting effected by the machine will be in the proper location on the label, ticket or tag of the particular kind or characteristics then desired to be imprinted and dispensed.

Such re-setting or re-adjustment for different width and/or length and for each differently pre-printed label, ticket or tag is not only time-consuming but also requires a fair amount of skill for which the operator must be trained.

The magazine printer and disperser of the present invention overcomes the aforementioned disadvantages incident to the frequent change of length and width or other characteristics of the label, ticket or tag to be imprinted.

By the embodiment of present invention illustrated in the accompanying drawings, the roll of tape comprising the successive interconnected labels, tickets or tags (from which the individual label, ticket or tag is subsequently cut or otherwise detached) is loaded into the supply portion or magazine unit of the machine. As many magazine units may be provided for the same printing portion of the machine as there are different sizes and kinds of labels, tickets or tags to be imprinted from time to time. The printer portion and the magazine portion of the machine have quick-attachable and quick-detachable interconnecting means which are the same on all the magazines, so that whichever magazine is attached to the printer portion, the spacial relationship of the magazine portion to the printer portion will be exactly the same as that of any other magazine with a different label, ticket or tag supply therein.

Each magazine includes its own tape-guides for locating and confining the tape laterally in relation to the printer-head of the printer portion and also with its own intermittent tape-feeder for intermittently feeding predetermined or pre-selected lengths of the tape to correspond to the length of the label, ticket or tag to be cut or otherwise detached from the tape.

The present invention permits each of the several magazines to be kept loaded with a particular size and kind of label, ticket or tag, and with any particular pre-printing thereon, and permits the aforementioned adjustments to be made by one specially trained and skilled in making these adjustments, and permits the adjustments to remain intact for the entire roll of such labels, tickets or tags and indeed for successive rolls of the same size and kind of labels, tickets or tags to be loaded into the same magazine when the previous roll has been used up, no matter how often the particular magazine is detached from and re-attached to the printer portion, so that the operators of the machine need not be skilled in making such adjustments in the machine for the different sizes and kinds of labels, tickets or tags and so that the person skilled in making such adjustments is spared of the expenditure of his time and labor repetitively re-adjusting or re-setting the machine each time a different size or kind of label, ticket or tag is to be imprinted by the machine.

BRIEF DESCRIPTION OF THE FIGURES OF THE DRAWINGS

FIG. 13*a* represents a view of the latch plate.

FIG. 15 represents a vertical cross-sectional view of the print-impression block and of the cutter-assembly adjustably and detachably mounted thereto, taken on line 15—15 of FIG. 16.

FIG. 16 represents a vertical cross-sectional view on line 16—16 of FIG. 15.

FIG. 17 represents a vertical cross-sectional view on line 17—17 of FIG. 15.

FIG. 18 represents a vertical cross-sectional view on line 18—18 of FIG. 8.

FIG. 31 represents a front elevational view of the tape-pay-out or tape-delivery of the printer portion of the machine, but showing an alternative embodiment, namely, without any cutter or cutting mechanism.

FIG. 32 represens a side elevational view of the embodiment shown in FIG. 31.

FIG. 33 represents a top plan view of the embodiment shown in FIGS. 31 and 32.

DESCRIPTION OF THE ILLUSTRATED EMBODIMENT OF THE INVENTION

Figure 1:
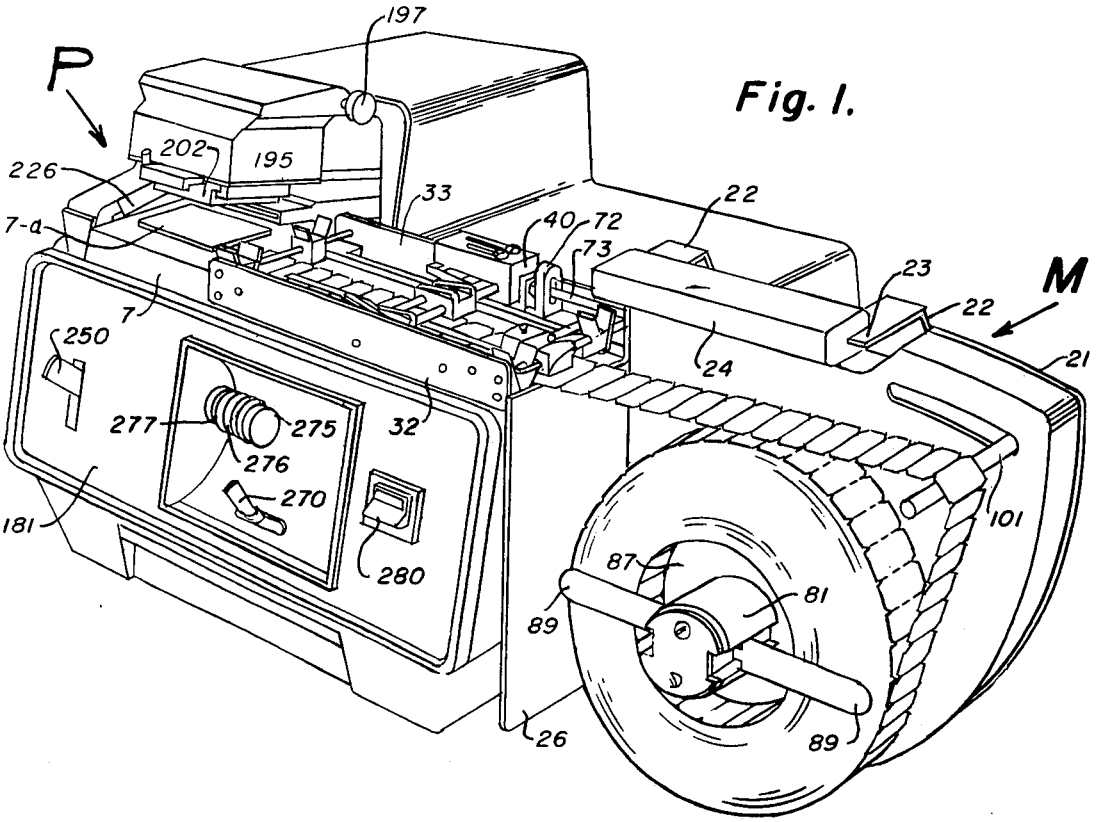
FIG. 1 represents a perspective view of a machine representing an embodiment of the present invention.
Figure 2:
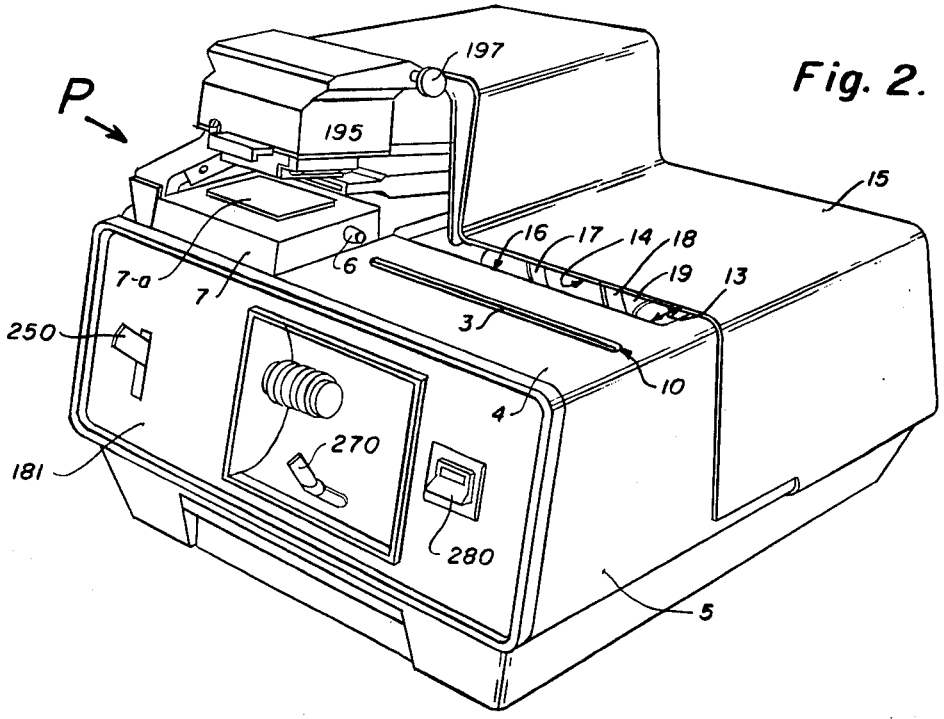
FIG. 2 represent a perspective view of the printer portion of said machine, with the magazine portion thereof removed, and ready to receive a magazine portion.
Figure 3:
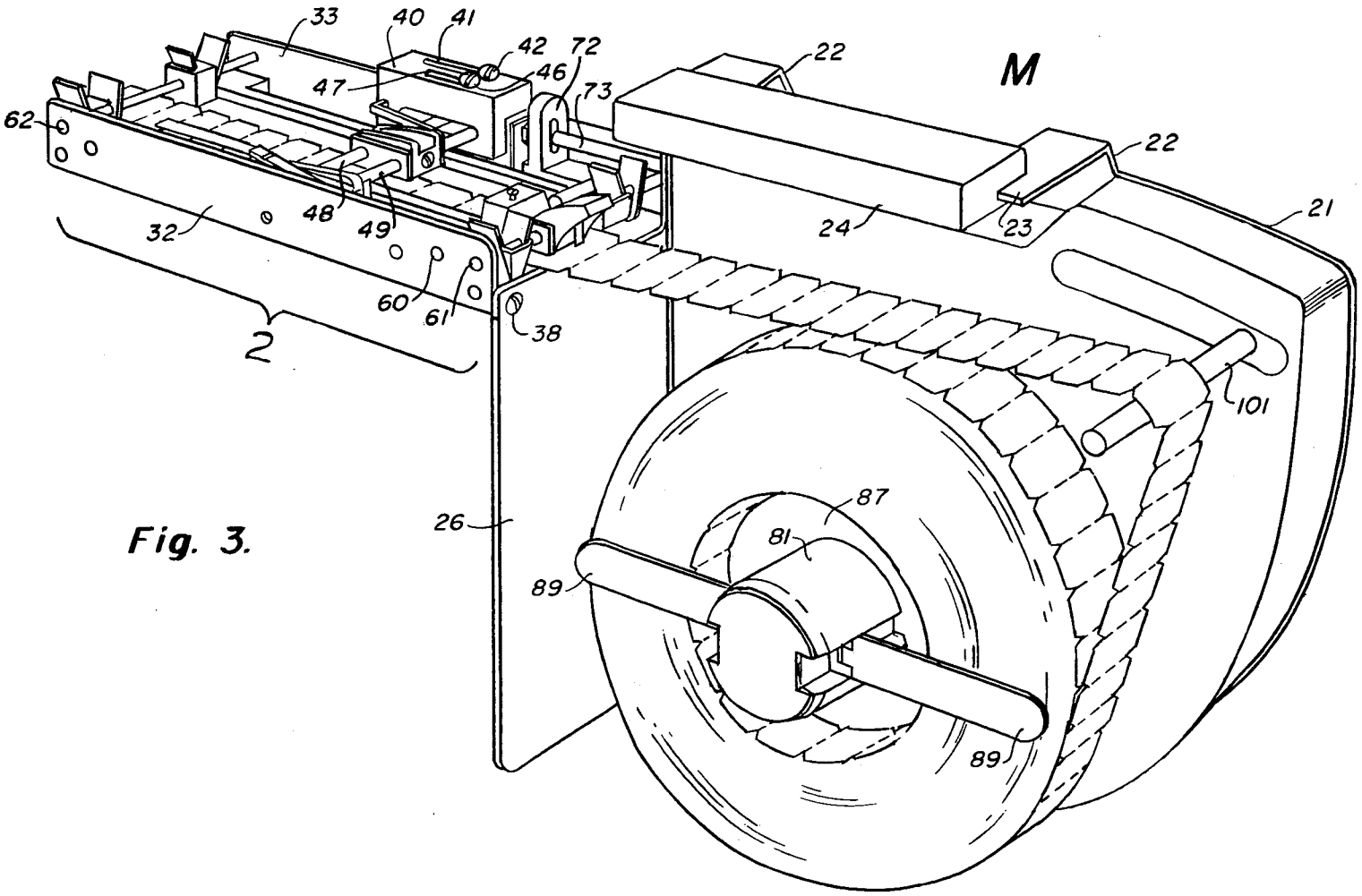
FIG. 3 represents a perspective view of the magazine portion of the machine, shown on a somewhat larger scale.
Figure 4:
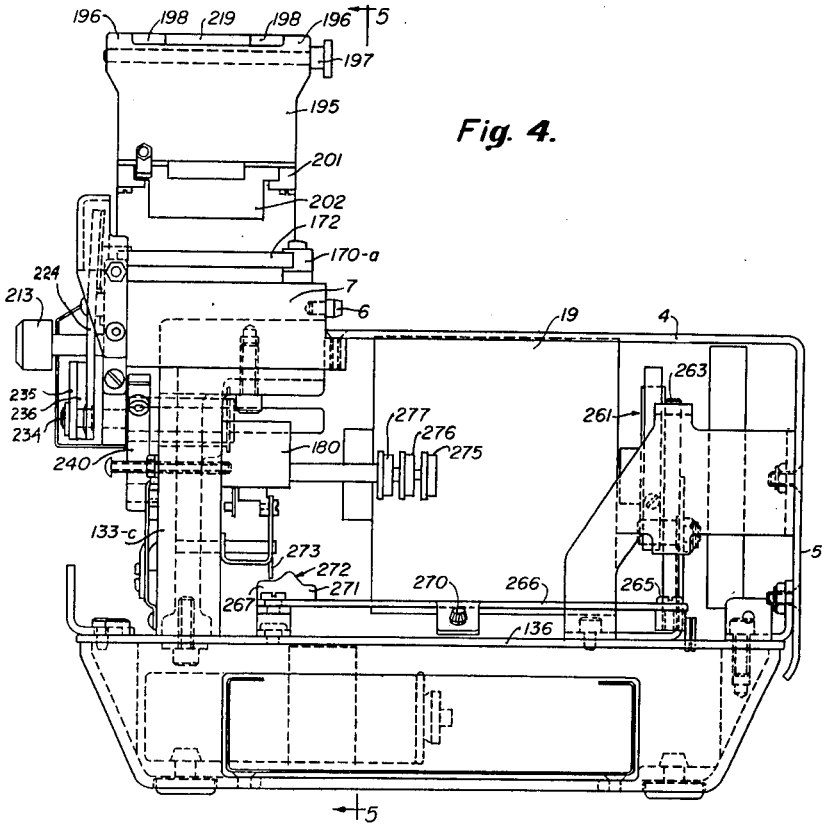
FIG. 4 represents a front elevational view of the printer portion of the machine, with the front covers removed therefrom.
Figures 20, 21, 22, 27, 28:
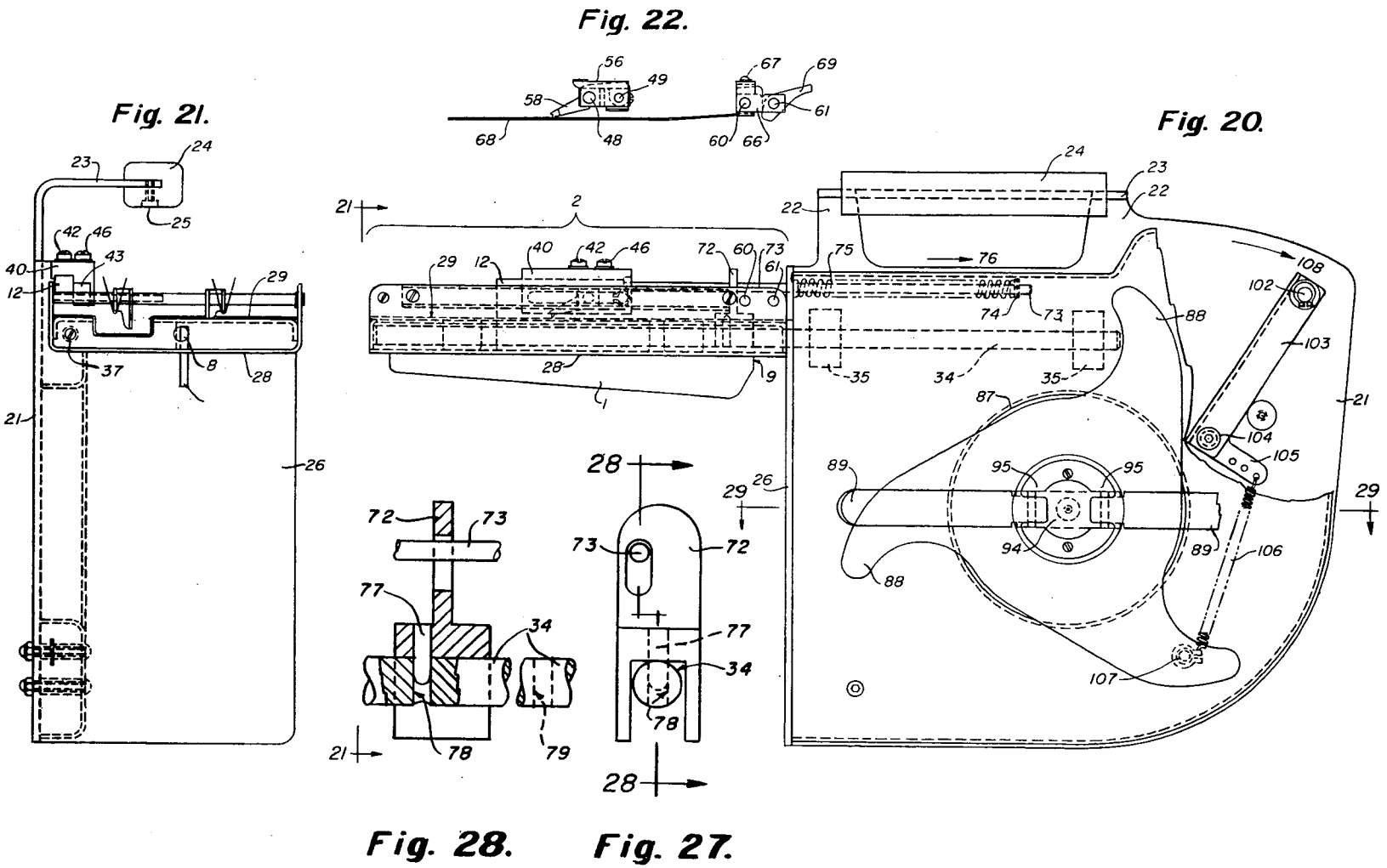
FIG. 20 represents a front elevational view of the magazine portion of the machine.
FIG. 21 represents an end elevational view of the magazine portion, viewed on line 21—21 of FIG. 20.
FIG. 22 represents front elevation view of the feeder-finger block and of the tape-check block and of the flat hold-down spring forming parts of the tape-feeder of the magazine.
FIG. 27 represents an end elevational view (on an enlarged scale) of the shuttle-locator.
FIG. 28 represents a cross-sectional view on line 28—28 of FIG. 27.
Figure 25:
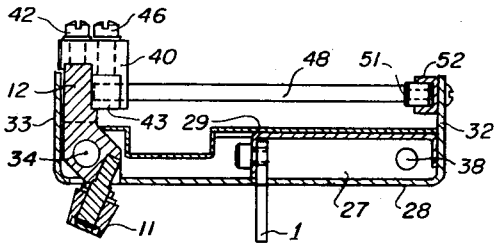
FIG. 25 represents a vertical cross-sectional view on line 25—25 of FIG. 23, of a tape-feeder adapted for string-tags; taken through the center of the cam-follower roller of the tape-feed slider or shuttle.
Figure 26:
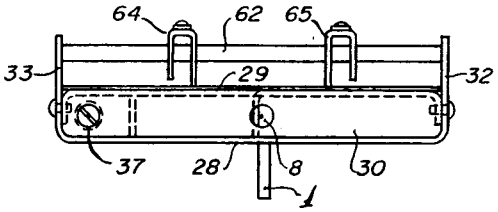
FIG. 26 represents an end-view of a tape-feeder for labels, tickets and stringless tags, viewed on line 26—26 of FIG. 23.

The machine, shown in its entirety in FIG. 1, comprises two co-operative portions, namely, the printer portion P shown in FIG. 2 and the tape magazine-and-feeder portion M shown in FIG. 3 arranged to be co-operatively united with each other as shown in FIG. 1, in a quick-attachable and quick-detachable manner. Such union between the magazine portion and the printer portion is effected by means of the elongated vertical rib 1 extending downwardly from the bottom of the tape-bed (27) of the tape-feeder portion 2 of the magazine M (FIGS. 20 to 26, inclusive). The rib 1 snugly nests in the slot 3 in the magazine-supporting bed-plate 4 forming a part of the cover-like bracket 5 of the printer portion P and by means of the slightly tapered dowel-pin 6 carried by the impression-pad-block 7 (FIG. 2), which dowel-pin 6 enters and snugly nests in the hole 8 in the end of the tape-bed (27) of feeder portion 2 of the magazine M (FIGS. 21 and 26). The rear vertical edge 9 (FIG. 20) of the guide-rib 1 fits snugly against the outer end 10 of the slot 3 (FIG. 2), so that when the magazine M is applied to the printer P with the hold 8 telescoped onto the pin 6 and with the rib 1 allowed to drop into the slot 3, the magazine will be in its predetermined spacial relationship to the printer.

Figure 6:
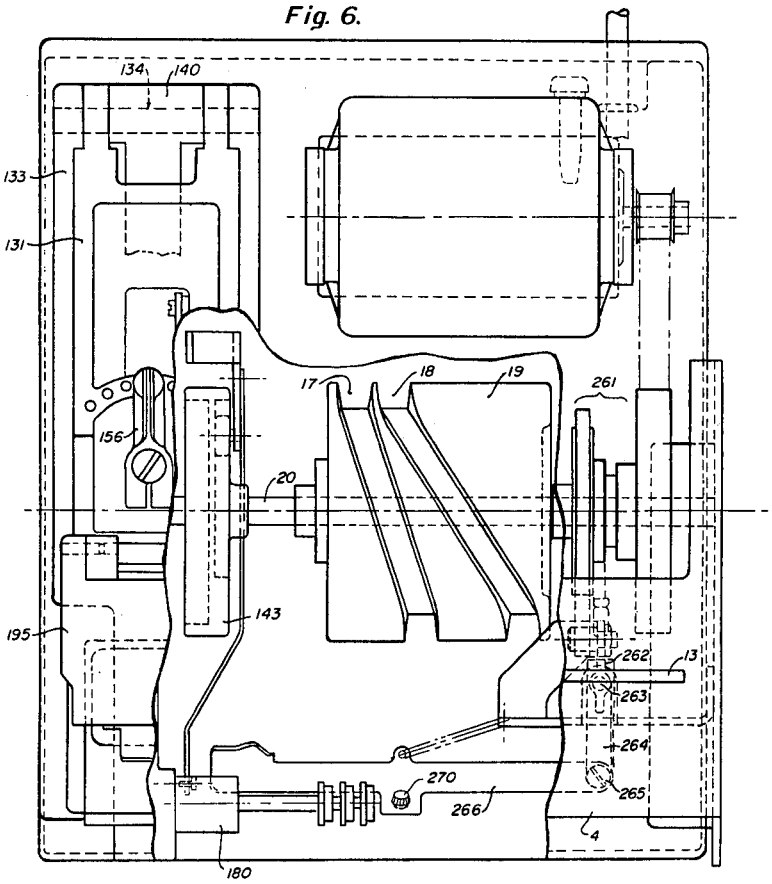
FIG. 6 represents a top plan view of the printing portion of the machine, with the upper magazine-supporting bed-plate and part of the printer-arm and printer-head broken away.

In such position, the cam-follower roller 11 (FIG. 25) carried by the tape-feed-slider 12 (FIGS. 25 and 23) extends through the clearance 13 between the front edge 14 of the rear top cover 15 and the rear edge 16 of the front cover 4 and enters one of the two cam-grooves or races 17 and 18 in the drum-cam or barrel-cam 19 carried by the main shaft 20 of the machine (FIGS. 2 and 6).

The magazine M includes a back-frame-plate 21 having two upward extensions 22 interconnected by the integral horizontal cross-piece portion 23 disposed at a right-angle to extensions 22. The cross-piece 23 nests in a horizontal slot in the wooden or plastic handle 24 which is secured thereto by one or several screws 25 as indicated in FIGS. 20, 21, 3 and 1.

Figure 23:
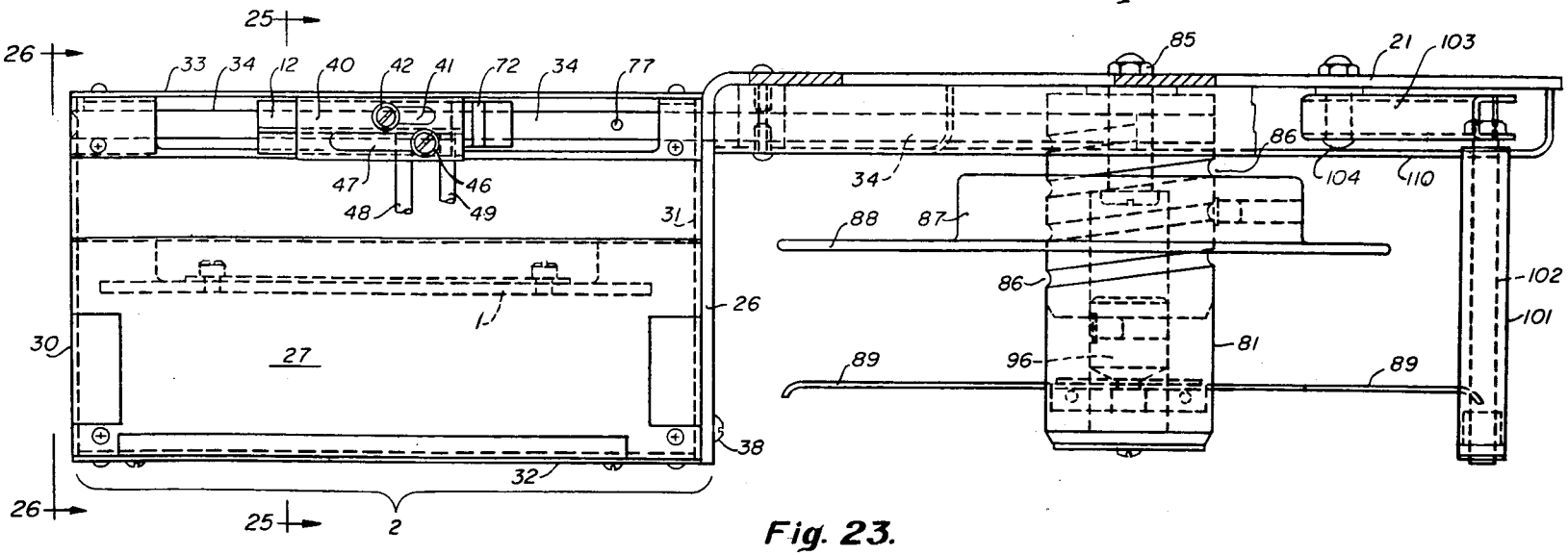
FIG. 23 represents a top plan view of the magazine portion of the machine.

A downwardly extending flange-like frame plate 26 is generally at a right angle to the rear frame-plate 21 and is formed integrally therewith as indicated in FIGS. 23, 21 and 20. The frame-plate 26 extends forwardly in distance generally equal to the fore-and-aft dimension of the tape-feed mechanism 2 as shown in FIG. 23.

The feed-bed, designated generally by the numeral 27 (FIG. 23), comprises a lower horizontal plate 28 and a upper horizontal plate 29 and a left vertical end-plate 30 and a right vertical end-plate 31 and a front vertical plate 32 and a rear vertical plate 33.

A round guide-rod 34 extends through and neatly nests in corresponding holes in the rod-supporting blocks 35 and 36 which are secured through the frame-plate 21 by suitable screws or the like. The guide-rod 34 extends through the frame-plate 26 of the frame portion of the magazine M and also through the end-plate 31 of the tape-feed-bed 27 and extends to the left end-plate 30, and is held thereto by the beaded screw 37 whose head bears against the end-plate 30 and whose stem is threaded into a threaded axial hole in the end of the guide-rod 34. A headed screw 38 extends through the frame-member 26 of the magazine M and is threaded into the vertical end-plate 31 of the tape-feed-bed 27 or into a nut-like stamping within the tape-feed-bed 27 adjacent the inner face of the vertical end-plate 31 of the tape-feed-bed 27 (see FIGS. 20, 21, 23 and 25). The combination of the stationary guide-rod 34 and screws 37 and 38 hold the entire tape-feed-bed 27 in assembled relation to the magazine frame plates 21 and 26.

The slider or shuttle 12 (FIGS. 23, 25, 20, 21) has a horizontal hole therethrough, through which the guide-rod 34 extends with a neat sliding fit. An intermediate feed-finger-supporting block 40, having a longitudinal channel on the underside thereof, is adjustably secured to top of the slider 12, with the uppermost portion of said slider 12 nesting in said channel, as shown in FIGS. 25 and 21. An elongated opening 41 is provided in the block 40, through which the headed screw 42 extends, with its stem threaded into a corresponding vertical threaded hole in the slider 12, thereby adjustably to secure the block 40 to the slider 12. A steel block 43 is disposed alongside of the upper portion of the slider 12, nested between the downwardly extended flange 44 of the block 40 and the slight shoulder 45 of the slider 12. The block 43 is secured in the block 40 by means of the headed screw 46 which extends through the elongated opening 47 in the block 40 and is threaded into a vertical hole in the block 43, thereby adjustably securing the block 43 to the block 40. Parallel polished steel rods 48 and 49 are press-fitted into corresponding holes in the rod-block 43 (FIGS. 23, 24 and 25) with their outer ends interconnected by the bridging plate 50. The end of the rod 48 extends forwardly beyond the bridging plate 50 and has a roller 51 revolvably mounted thereon. The roller 51 extends into a channel member 52 carried by the front plate 32 of the tape-feed-bed 27, thereby to support the front ends of the finger-carrying rods 48 and 49 (FIGS. 24 and 25).

A pair of finger-blocks 55 and 56, with parallel holes therethrough corresponding to the rods 48 and 49, are slidably mounted on said rods, with their positions thereon adjustable and set in their adjusted positions by set-screws 53. Each of the finger-blocks, 55 and 56 carries the two different kinds of tape-feed fingers 57 and 58, namely, the diamond-ended fingers 57 and the flat-ended fingers 58; each biased in a downwardly direction by means of leaf springs or other suitable springs. The fingers 57 are adapted to engage in the V-shaped notches along the edges of the tape (where such tape is provided with such notches), while the fingers 58 are adapted to engage in slots disposed intermediate the edges of the tape (where the tape is provided with such slots). In either case, one of the pair of fingers 57 or one of the pair of fingers 58 may be de-activated, by raising it into its inoperative position, with the aforementioned leaf spring folding it in its inoperative position by bearing against it suitable flat on the pivoted end of the finger.

The adjustments by means of the screw 42 in the slot 41 and further adjustment by means of the screw 46 in the slot 47 serve to adjust the fingers (57 or 58) so that at the end of the feedstroke of the slider 12, the leading edge of a label, ticket or tag will be at the appropriate imprinting position, for receiving the imprint from the type-chase or band type printer in proper relation to the label, ticket or tag and for cutting off such label, ticket or tag at the proper point (where the same are to be cut off by the cutter mechanism shown in FIGS. 8, 9, 15, 16 and 17, as described hereinafter).

Figure 24:
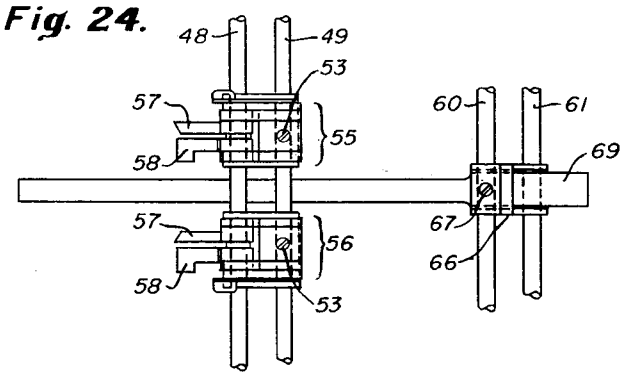
FIG. 24 represents a fragmentary portion of the top plan view of the tape-feeder, showing the tape-feed bars and the laterally adjustable feeder-fingers thereon, and also showing the hold-down leaf-spring carried thereby.

A pair of parallel horizontal guide-rods 60 and 61 extend between and are secured to the front and back vertical plates or flanges 32 and 33 of the tape-feeder bed 27 (FIGS. 20, 23 and 24). A pair of tape-guides 64 and 65 are adjustably mounted on the rod 61 and are provided with set-screws for securing them in their desired positions along the edges of the tape, to determine the position of the tape in relation to the printing-head of the machine.

A spring-carriage 66 is adjustably mounted on the two rods 60 and 61 and is held in its adjusted position by a set screw 67. The carriage 66 carries a flat leaf-spring 68 extending leftwardly thereof, parallel to the tape-pass and bearing down on top of the tape with sufficient pressure and over a sufficient length of the tape to keep the tape from buckling during the course of the feeding thereof. A tape-check 69 is pivotally mounted on the rod 61, with a downwardly extending toe portion thereof urged against the upper surface of the tape by a spring and so arranged as to permit the tape to be advanced past the tape-check but as to prevent the tape from backing up in the reverse direction.

A shuttle-locator 72 is slidably mounted on the guide-rod 34, to the right of the slider or shuttle 12 (FIGS. 20, 23, 27 and 28) and has a locating pin 77 which is dropped into either one of the holes 78 and 79 in the rod 34, according to whether the cam-follower-roller 11 of the shuttle 12 is to be in cam-race 17 or in cam-race 18 (FIG. 6).

A shuttle-retracting rod 73 extends through the frame-plate 26 and through a vertical clearance slot 71 in the shuttle-locator 72 and has its left end threaded into or otherwise anchored to the shuttle or slider 12. A helical compression spring 75 is mounted on the shuttle-retracting rod 73 between the frame-plate 26 and a suitable spring-abutment 74 on the right-hand end of the rod 73 (as indicated in FIG. 20) so as to urge the rod 73 in the direction of the arrow 76 (FIG. 20). By this means, the shuttle 12 is moved in the direction of the arrow 76 against the shuttle-locator 72 whenever the machine is stopped by the de-activation of the clutch 261 (FIGS. 37, 4, 6 and 9).

As the de-activation of the clutch 261 (FIGS. 37, 4, 6 and 9) always stops the printer P (FIG. 2) at the same point of its cycle, the cam-follower-roller 11 of the ticket-feed shuttle 12 will be so located that if any magazine M (FIG. 3) is at any time removed from the printer and later re-applied thereto, the cam-follower-roller 11 will enter the same cam race as that in which it had been disposed prior to the removal of the magazine, as required by the ticket-length of the tape in the magazine. By raising the shuttle-factor 72 and dropping the pin 77 thereof since one of the holes 78 the cam-follower-roller 11 with be located for cam-groove 17, while by dropping the pin 77 in the hole 79 the cam-follower-roller 11 will be located for the cam-groove 18.

By way of illustration, the cam-groove 17 has a throw of 1 1/16 inches and the cam-groove 18 has a throw of 2 1/16 inches. The extra one-sixteenth inches in the throw of each cam-groove 17 and 18 is to provide an override above the respective maximum 1 inch and 2 inches tape-feed lengths, to insure the engagement of the notch or hole in the tape by the feed-fingers 57 or 58 when set for the maximum 1 inch or the 2 inches ticket-lengths, respectively.

By means of the screws 42 and 46, the position of the finger-rod-carrying block 43 is so adjusted in relation to the print-impression pad or platen 205 of the printer (FIG. 2) that the label, ticket or tag will be properly located in relation to the type-chase or band-printer carried by the printer-head 195 (FIGS. 1, 2, 4 and 5).

The tape-feeder-fingers (57 and 58) ride freely over the upper surface of the label until they drop into and engage in the next notch or hole therein, and from that point on the fingers feed the tape an amount or length which is equal to the rest of the finger-travel from such engagement-point to the end of the finger-travel provided by the throw of the cam-race 17 or the cam-phase 18.

A separate type-chase may be provided for each tape supplying and feeding magazine M, so that by inserting the type-chase having type set therein corresponding to the particular magazine, no adjustment is necessary of the tape-feed-fingers or of the lateral tape-guides or of the cam-groove selector because all these adjustments or settings remain intact no matter how often the same magazine (and its corresponding type-chase) is removed from the re-applied to the printer portion P of the machine.

If a band-printer is mounted to the mounting-plate secured to the front end of the pivoted printer-arm 131 (in place of chase-carrying the printer-head 195), it is only necessary to dial the various type-bands thereof according to the imprinting required for the particular label, ticket or tag for which the particular magazine is loaded, and such band-setting or the imprinting required for such magazine can be marked on casing, housing, frame or handle of the magazine.

Figure 29:
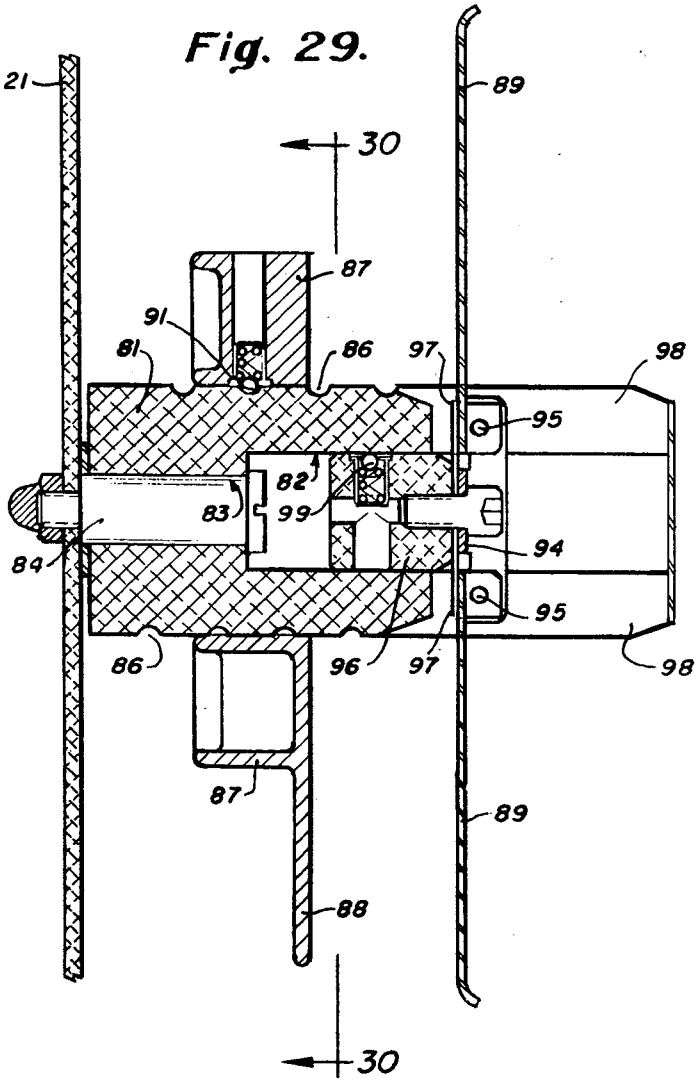
FIG. 29 represents an axial cross-section of the hub of the magazine, on line 29—29 of FIG. 20.

A horizontal and generally cylindrical tape-roll-hub 81 is revolvable mounted to the back-frame-plate 21 of the magazine in the manner indicated in FIGS. 29, 23, 20, 3. The hub 81 has a cylindrical hole 82 therein, and a smaller-diametered co-axial hole 83 extending from the inner end of the hole 82 through the rear end of the hub 81, thereby providing a shoulder between set two holes or bores. A head pivot 84 extends through the smaller diametered hole or bore 83, with its head bearing against the shoulder between the two bores, and the threaded reduced-diameter rear end of the pivot 84 extends through the back-frame-plate 21 of the magazine and has a nut 85 threaded thereon, whereby the hub 81 is secured to the frame-plate 21. The tape-roll-hub 81 is revolvable on the pivot 84 (FIG. 29).

A spiral groove 86 is provided in the outer surface of the hub 81, as indicated in FIG. 29. A larger-diametered hub 87 has a bore therethrough which neatly fits over the hub 81. The hub 87 is mounted on the hub 81 in either of two alternative ways. It can be mounted in the manner indicated in FIGS. 23 and 29, with its flange-portion 88 disposed forwardly of the hub 87. In this disposition or mounting of the hub 87, a roll of tape having a small center opening or core-size is adapted neatly to fit over the smaller diameter of the hub 81, is placed over the hub 81 with its back face against the flange-portions 88, and with its front face retained by the pivotally-mounted and spring-biased retainer-arms 89 described hereinafter. If the roll of tape has a central opening or hub-receiving opening of the diameter of the larger hub 87, then the hub 87 is reversed on the hub 81, so that the flange-portions 88 thereof are rearwardly of the hub 87, and the roll of tape is mounted on the hub 87 (which is now forwardly of the flange 88 thereof), and such roll of tape is retained between the flange 87 and the spring-biased pivotedly-mounted retainer-arms 89.

Figure 30:
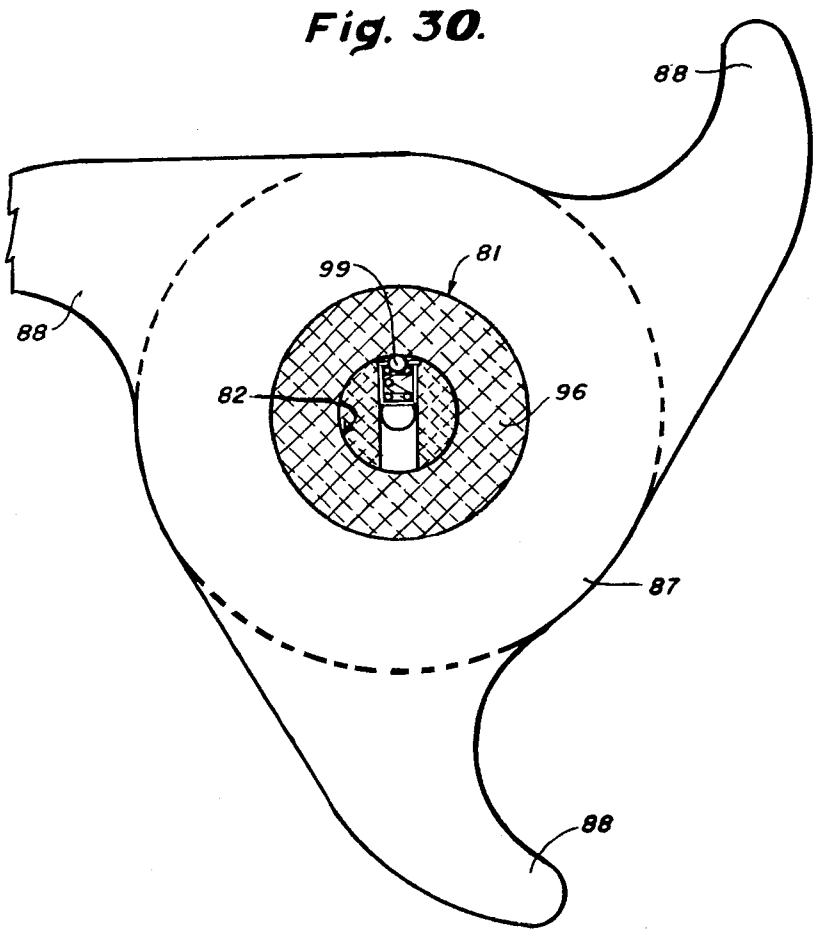
FIG. 30 represents a cross-sectional view of line 30—30 of FIG. 29.

The hub 87 has a suitable spring-urged detent or ball-like detent 91 mounted in a radial hole therein. Thus the ball and spring may be operatively mounted in a small tubular brass housing which is pressed-fitted into the radial hole in the hub. The detent-ball 91 rides in the spiral groove 86, so that by turning the outer hub 87 in relation to the inner hub 81, the larger-diametered outer hub 87 can be located anywhere along the smaller diametered inner hub 81 within the axial extent of the spiral groove 86. This permits the accommodation of different widths of tape-rolls, and also permits the variation of the axial location of tape-roll so as to place it in operative alignment with the type in the type-chase or with the type faces of the band-printer carried by the printer-arm 131. See FIGS. 23, 29 and 30.

The outer retainer-arms 89 are pivotally mounted to a retainer-block 94, about the pivot pins 95. The retainer block 94 is secured to a cylindrical plunger or plug 96 by means of a suitable co-axial screw, and between the plug 96 and the block 94 a leaf-spring 97 is mounted, overlapping the flat on the pivoted ends of the retainer-arms 89, thereby to retain said arms in their extended or operative position unless the arms are bent forwardly (against the force of the leaf-spring 97) until the leaf-spring bears against the flat inner ends of the arms, in which position the spring 97 will keep the arms extended parallel to the axis of the hub 81.

Diametrically opposite slots 98 are provided in the outer end of the hub 81, to the point at which the outer end of the spiral-groove 86 terminates. These slots 98 are of a width less than the diameter of the bore 82 in the hub 81 and of such width as to accommodate the retainer-block 94. The plug 96 has a radially-acting spring-loaded detent-ball 99 mounted therein, bearing against the inner surface of the bore 82 in the hub 81, so as to retain the plug 96 and the outwardly-extended retainer-arms 89 in any desired axially-variable position, namely, in a position in which the retainer-arms bear suitable against the outer face of the tape-roll and confine it neatly between said arms and the flange 88 of the outer hub 87. See FIGS. 20, 23, 29 and 30.

A slack-roller 101 is revolvably mounted upon a pivot 102 mounted to the upper end of the rocker-arm 103, as indicated in FIGS. 20 and 23. The rocker-arm 103 is pivoted at 104 to the rear frame-plate 21. The lower arm 105 of the rocker-arm 103 is provided with a series of holes (FIG. 20) into one of which the upper end of the helical tension spring 106 is anchored, with the lower end thereof anchored to any suitable spring-anchorage 107 carried by the rear frame-plate 21, thereby to urge the slack-roller 101 in the direction of the arrow 108. By looping the tape around the roller 101, as it passes from the roll thereof on its way to the tape-feed-bed 27 (FIS. 1, 20 and 23) a suitable amount of slack is always provided in the tape, between the roll thereof and the feed-fingers (57 or 58), so that when the feed-fingers engage the tape and advance it, such advancement will not be opposed by the inertia of the entire tape-roll, but such advancement can be from the slack in the tape.

The printer-arm 131 (FIGS. 5, 7, 8 and 12) includes two spaced-apart arm portions or webs **131-*a* and 131-*b*, and has the pivot-ears or portions 132-*a* and 132-*b* at the rear end thereof. The rear end (132) of the printer-arm 131 is pivotally mounted on the top of the rear end of the printer-frame 133, by means of the pivot 134 which extends through the rear-most pivot-portions 135-*a* and 135-*b* of said printer-frame 133.**

The printer-frame 133 includes two spaced-apart longitudinal frame portions **133-*a* and 133-*b* at the top thereof, and includes a lower base portion 133-*c* secured to the base-plate 136.**

Figure 12:
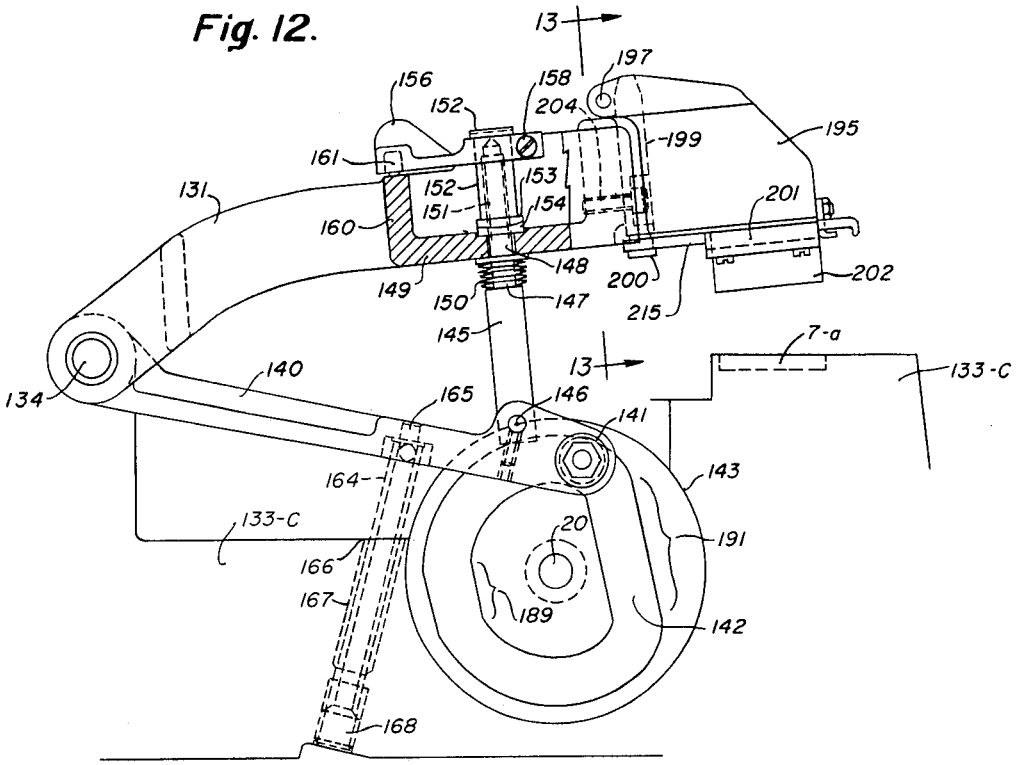
FIG. 12 represents a left elevational view of the printer-arm and its actuating mechanisms, with a printer-head shown thereon adapted to receive a type-chase.
Figure 14:
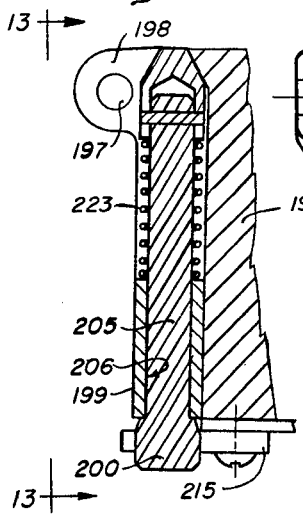
FIG. 14 represents a vertical cross-sectional view on line 14—14 of FIG. 13.

A printer-actuator arm 140 is also pivoted on the pivot 134 (on which the printer-arm is pivoted) and carries the cam-follower-roller 141 (FIGS. 13 and 18) which rides in the cam-groove or cam-raceway 142 recessed into the left face of the cam-disc 143 carried by and keyed (or otherwise locked) to the main shift 20. A connector-rod 145 is operatively interposed between the printer-actuator-arm 140 and the printer-arm 131 an indicated in FIG. 12. The lower end of the connector-rod 145 is pivoted as the actuator-arm 140 by the pivot 146, while the upper reduced-diameted end 147 thereof extends through a clearance hole 148 in the horizontal web 149 of the printer-arm 131, with a relatively stiff compression-spring 150 intervening the lower surface of the web 149 and the shoulder between the main body portion 145 and the reduced-diametered portion 147 of the connector-rod 145. The upper portion 151 of the reduced-diametered upper extension 147 of the connector-rod 145 is threaded, and an internally threaded bushing 152 is threaded onto the extension 151. The upper end of the bushing 152 is provided with a slot for receiving a screw-driver or the like, whereby the bushing can be turned for the impression-adjustment thereof in relation to the threaded portion 151 of the connector-rod 145. The lower end of the bushing 152 rests and bears on the upper flat surface of the washer 153, whose lower surface is convexly spherical. Such lower spherical surface of the washer 153 in turn rests on and nests in the concavely spherical surface of the lower washer 154. The lower washer 154 in turn nests in a slight recess in the web 149 of the printer-arm (FIG. 12). By this means, the slight changes in angularity between the connector-rod 145 and the printer-arm 131 are accommodated without any binding or stressing of the rod or the arm.

An impression-adjusting arm 156, having a split-collar 157 embracing the bushing 152, is adjustably secured to the upper end of the internally threaded bushing or sleeve 152 by means of screw 158. The impression-adjusting arm 156 is so secured on the bushing 152 that the bushing is initially adjusted for the desired print-impression when the arm 156 is the mid-point of its impression-adjusting sweep (FIGS. 12 and 7).

Figure 7:
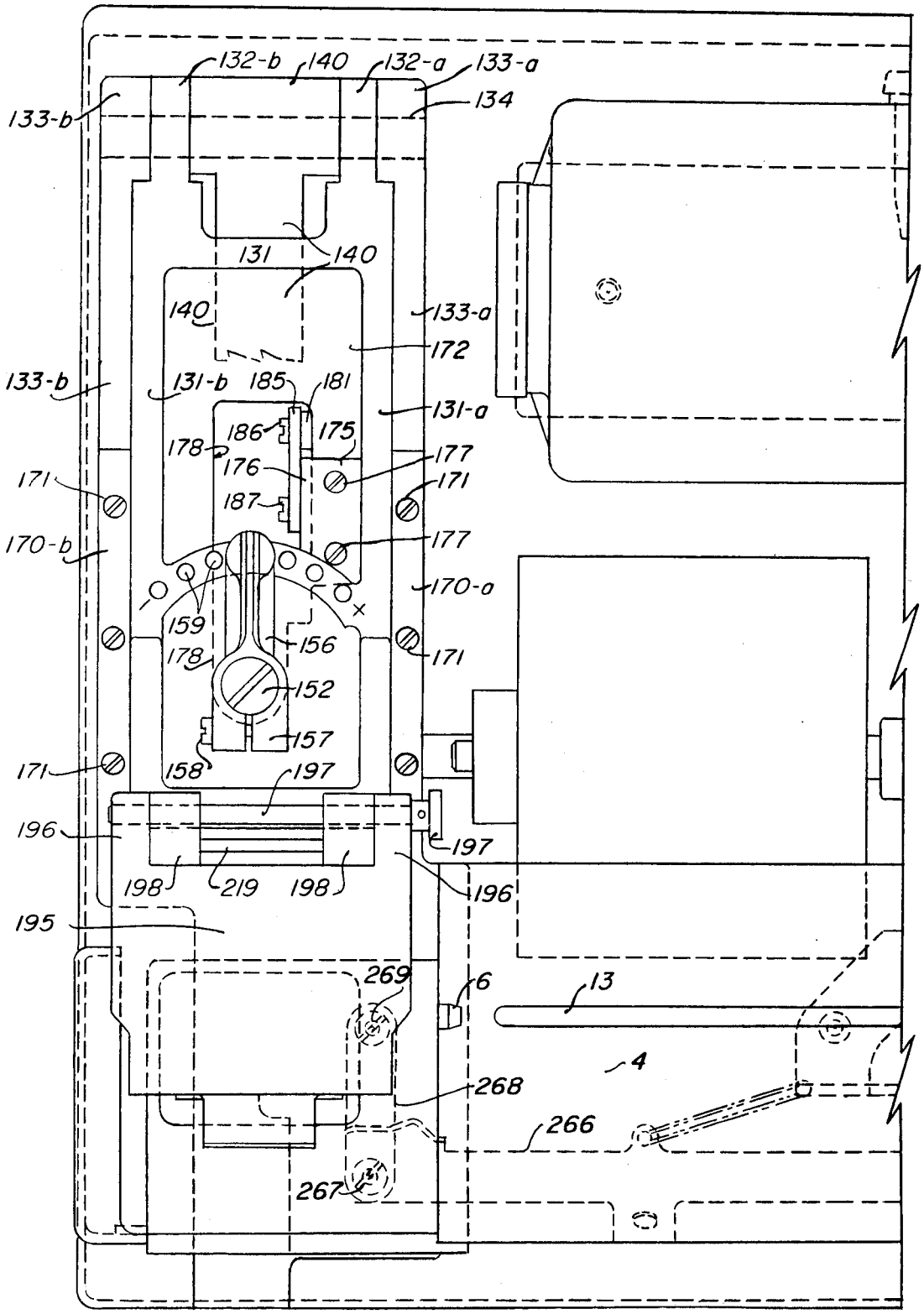
FIG. 7 represents a top plan view of the printer-arm and printer-head carried thereby.

A suitable number and suitable spaced apart detent-engageable shallow recesses 159 are provided in the upper face of the arcuate web 160 (of the printer-arm 131) which is concentric with the axis of the impression-adjusting-bushing 152 (FIG. 7). The free end of the impression-adjusting arm 156 sweeps over the upper surface of the web 160 in close proximity thereto and carries a spring-loaded detent-ball 161 (FIG. 12) of any suitable conventional type, for nesting in any one of the detent-receiving recesses 159, thereby to maintain the impression-adjusting arm 156 in any one of its selected positions coresponding to the selected recess 159. By turning the arm 156 in the direction of the plus mark in FIG. 7, the print-impression is increased, and by turning the arm 156 in the opposite direction, namely, in the direction of the minus sign, the print-impression is decreased. By this means the print-impression may be adjusted to accommodate different thicknesses of the ticket, label or tag stock and also to accommodate different kinds of ink and for other variables involved in the printing.

Figure 8:
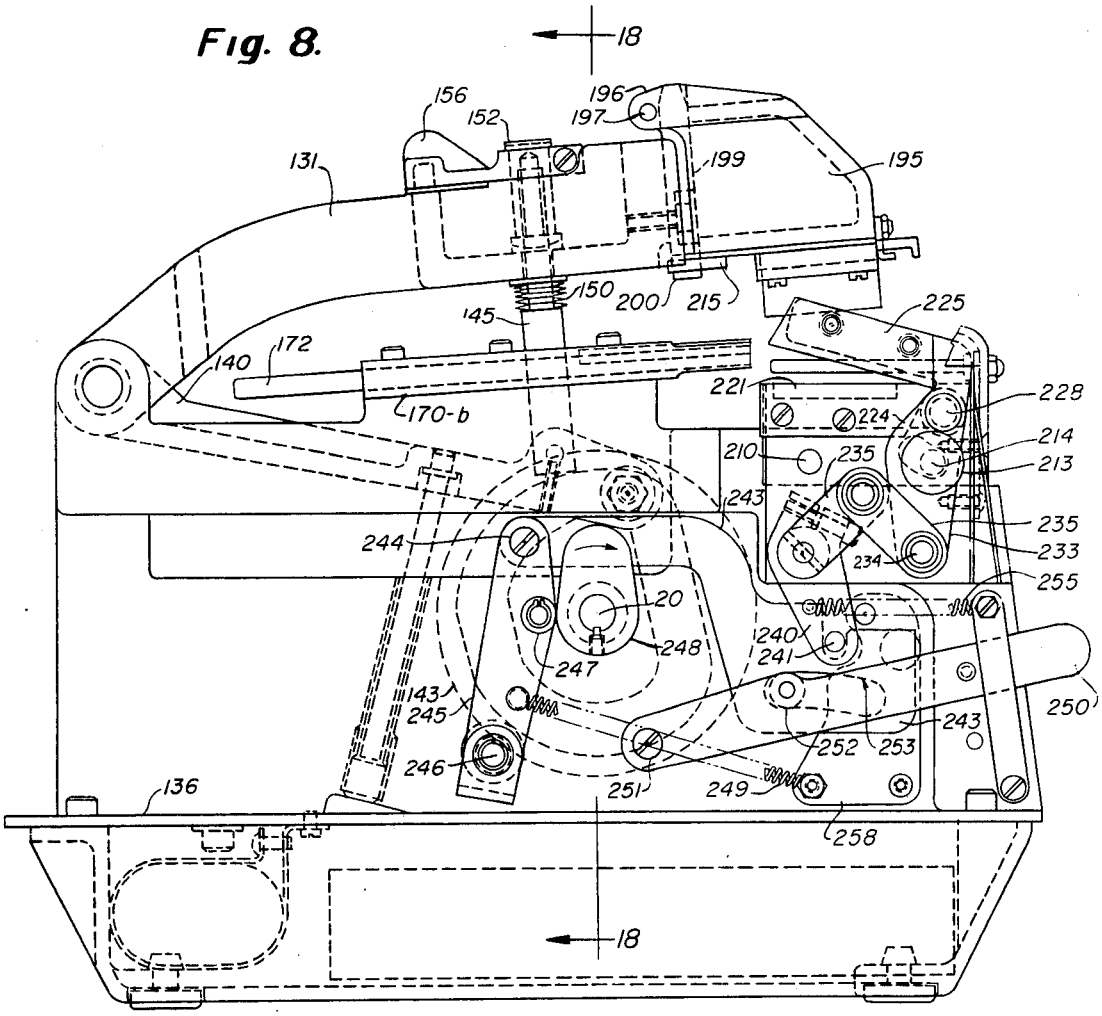
FIG. 8 represents a left side elevational view of the printing portion of the machine, with the left cover removed therefrom.

A helical compression spring 164 is operatively interposed between the printer-actuaor arm 140 and the lower printer-frame portion 133-*c*, in the manner indicated in FIGS. 8 and 12, thereby to urge the cam-follower-roller 141 against the outer surface of the cam-raceway 142, so as to eliminate any slack or play between the cam-groove or raceway 142 and the printer-actuator-arm 140. The upper end of the spring 164 is held in place by the pilot 165 carried in a slight recess in the arm 140. From the point 166 downwardly (FIG. 12) the spring 164 extends through a cylindrical hole 167 in the lower portion 133-*c* of the printer-frame 133, in which hole it is confined (with only working clearance) to prevent the buckling thereof. The lower end of the spring 164 rests on a screw-plug 168 threaded with the lower end of the hole 167 and having a suitable recess for engagement by a screw-driver or an allen wrench, whereby it can be turned for adjusting or varying the amount of compression of the spring 164.

To the two spaced apart parallel upper printer-arm members 131-*a* and 131-*b* (FIG. 7) a pair of facing channel-cross-sectioned inker-guide members 170-*a* and 170*b* are secured, by the screws 171.

An inker-slide 172 has its opposite sides slidably nested in the guide-channels 170-*a* and 170-*b* and is reciprocally therein in a fore-and aft direction.

Figure 10:
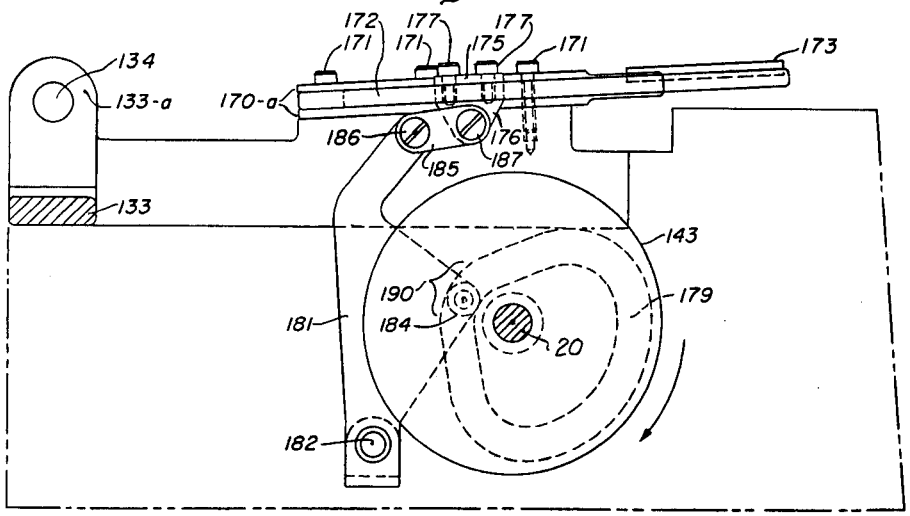
FIG. 10 represents a left side elevational view of the inker-slide and its actuating means, including the driving cam-groove or race and the cam-follower lever and linkage between the latter and the slide.
Figure 11:
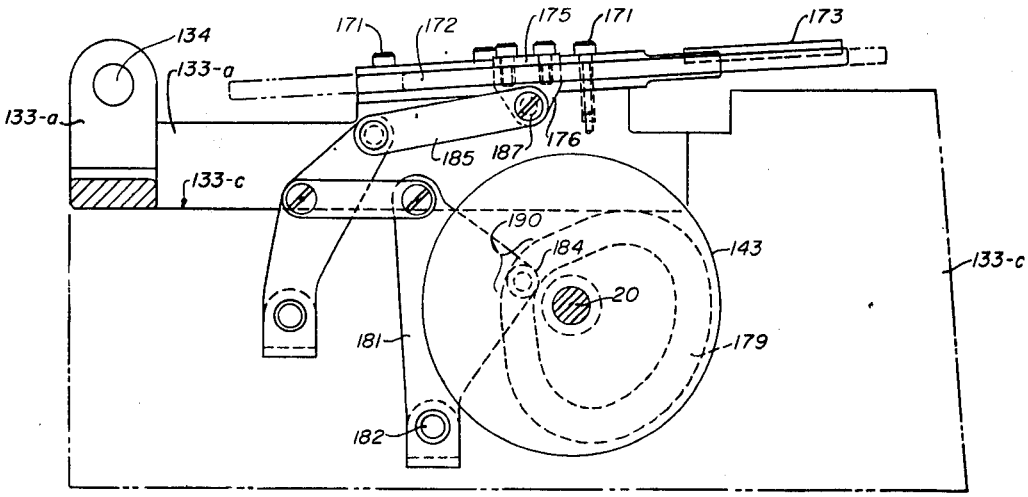
FIG. 11 represents another left side elevational view of the inker-slide and its actuating mechanism, showing an alternate linkage between the cam-groove and the slide, for a greater slide-travel than that provided by the linkage shown in FIG. 10.

A suitable shallow recess is provided in the upper surface of the front end of the ink-slide 172, and an upwardly-facing inking-pad 173 nested therein (FIGS. 10, 11 and 7).

A pivot-bracket, including an upper horizontal portion 175 and a downwardly extending right-angular portion 176 (FIGS. 7 and 10) is secured to the inker-slide 172 by means of screws 177. The lower downwardly-extending bracket-portion 176 extends through the opening 178 in the inker-side 172 (FIG. 7) through the front end of which opening the connector-rod 145 extends.

Figure 5:
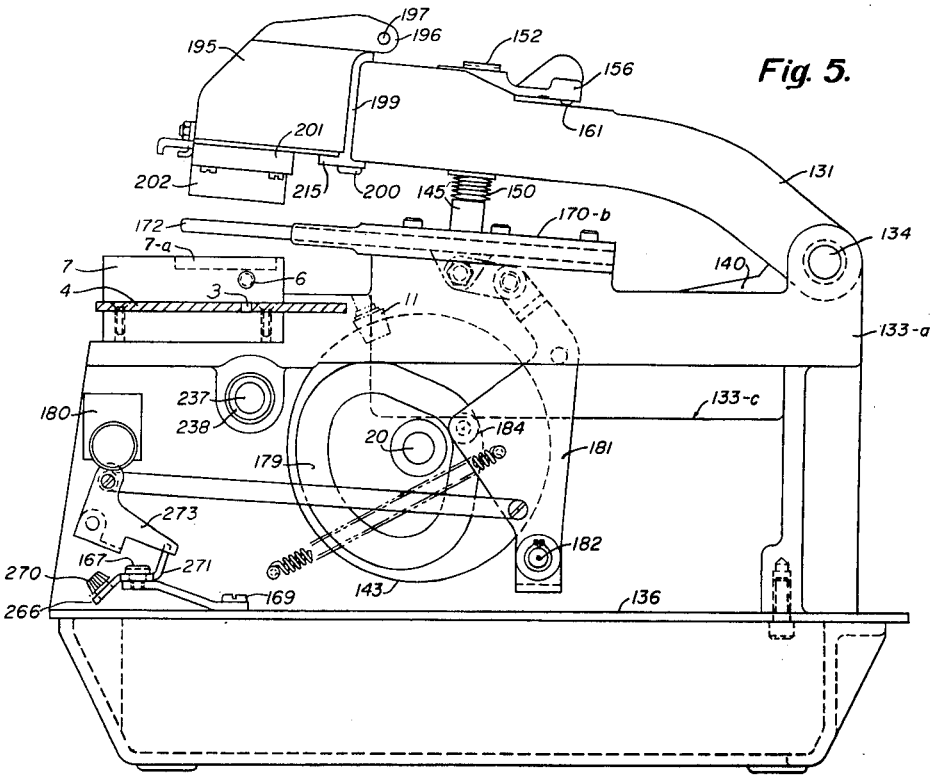
FIG. 5 represents a vertical cross-sectional view generally on line 5—5 of FIG. 4.

In the right-side face of the cam-disc 143 a cam-groove or raceway 179 is provided (FIG. 10) for actuating the inker-slide 172 and also for actuating the digital counter 180 (FIG. 5).

A cam-follower lever 181 is pivotedly mounted at its lower end on the pivot 182 carried by the printer-frame 133-*c* secured to the frame. The cam-follower-lever 181 carries a cam-follower roller 184 which rides in cam-raceway 179, to oscillate the arm 181 in a fore-and-aft direction. In the embodiment shown in FIG. 10, the upper end of the arm 181 is connected to the lower portion 176 of the pivot-bracket of the inker-slide by means of the link 185 pivoted at 186 and 187. By this means the inking-pad 173 is projected forwardly into operative juxtaposition to type-chase or other printing means carried by the printer-arm 131, just long enough for the type faces to make inking contact with the ink-pad 173 at the bottom of the downward inking stroke of the printer-arm 131 effected by the short inking-stroke portion 189 of the cam-raceway 142 (FIG. 12); the inking raceway 179 and the raceway 142 being so angularly disposed in relation to each other that the inking portion 190 of the raceway 179 will maintain the inking-pad 173 in its inking position just long enough for the type faces to make contact therewith, and then the raceway 179 immediately returns the inking pad to its retracted position. Thereafter the print-impression portion 191 of the printing raceway 142 lowers the printer-arm and maintains it in the printing-impression position long enough to make a satisfactory print impression. Thereafter the printer-arm is raised again.

The printer-head 195 is provided with a pair of chase-guides for receiving type-carrying chase 202. In the alternative, the printer-arm 131 may carry any other kind of variable type means, as, for instance, a band-printer head or the like. The printer-head or the band-printer is detachably mounted to the printer-arm 131 through the mounting block shown in FIGS. 12 and 13 and described hereinafter.

Block 7 is secured to the top of the front portion of the printer-frame member 133-*c* for supporting the print-impression pad or platen 205 and for supporting the tape-cutter, as indicated in FIGS. 4, 5, 8, 15, 16, 17. In a recess in the upper face of set block 7, a print-impression pad **7-*a* is nested, as indicated in FIG. 16.**

A cutter-assembly (shown in FIGS. 8 and 15–17) is slidably mounted to the impression-block 7, so that it can be adjustably moved laterally in relation to the block 7, parallel to the direction of tape-travel, whereby its cut-off line may be variably spaced from the printing area or print-impression on the label, ticket or tag, according to the length of the latter and according to the location of the print-impression thereon in relation to the leading and trailing edges thereof. The cutter-assembly can also be completely removed without disturbing any of the cutter-actuaing linkage; as when the labels, tickets or tags are to be separated by means other than cutting.

The cutter-assembly includes the laterally-movable vertical cutter-assembly block 207, which is parallel to the left vertical face of the impression-block 7, and can be spaced therefrom any suitable distance within the range of adjustment provided therefor, as described hereinafter in relation to FIGS. 15 to 17.

The block 207 is adjustably supported by the knife-pivot-sleeve 208 which is slidably mounted in horizontal bore 209 in the impression-block 7 and also by the guide-rod 210 which is slidably mounted in a corresponding bore 211 in the block 7. An adjustment-screw 212, having an outer turn-knob 213 detachably secured thereto, extends through the cutter-assembly block 207; with the block confined between the shoulder between the two differently diametered portions 212 and 214 thereof and the spring-washer 216 which is held in place by the locked nuts 217 on the threaded portion 212. The screw 212 is threaded into a threaded opening 220 in the block 7, so that by turning knob 213, the cutter-assembly block 207 can be optionally moved towards or away from the print-impression-block 7 for variably locating the cut-off line of the knife in relation to the printed matter on the label, ticket or tag. The stationary knife 221 is secured to the left vertical face of the block 207 by means of the screws 222.

Figures 17A, 17B, 17C:
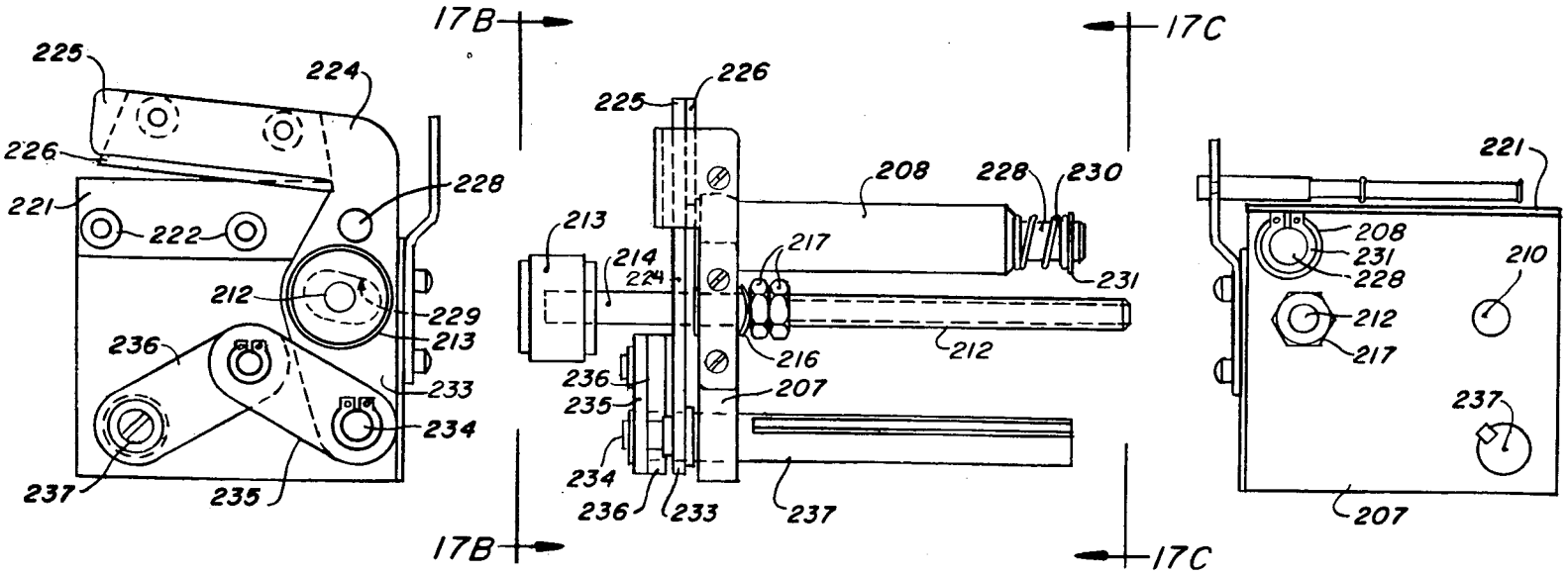
FIG. 17A represents a front elevational view of the cutter-assembly, detached from the print-impression block.
FIG. 17B represents a side elevational view of same, as viewed on line 17B—17B of FIG. 17A.
FIG. 17C represents a side elevational view of same, viewed on line 17C—17C of FIG. 17A.

The rocker-arm 224 (to the upper arm 225 of which the movable cutter-blade or knife 226 is secured by screws), is riveted or otherwise fixedly secured to the outer end 227 of the knife-pivot 228, as indicated in FIG. 17. The knife-pivot 228 is journalled in the sleeve 208 which is slidably mounted in the bore 209 of the impression-block 7. A helical compression spring 230 between a spring-anchorage ring 231 (on the inner end of knife-pivot 228) and the inner end of the sleeve 208 serves to keep the movable knife 226 bearing against the stationary knife 221.

The outer portion 214 of the adjustment-screw 212 extends through an arcuately elongated clearance-hole 229 (centered on the pivot 228) in the lower arm 233 of the rocker-arm 224.

Figure 9:
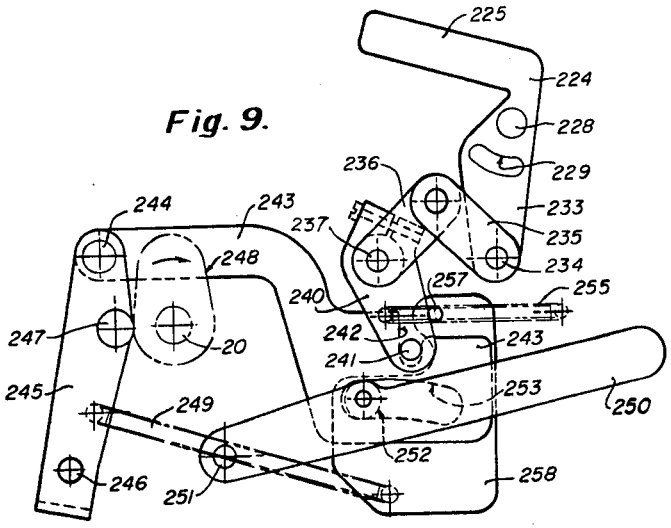
FIG. 9 represents an elevational view of the cutter linkage shown in FIG. 8.

The lower arm 233 of rocker-arm 224 carries a pivot 234 to which the link 235 is pivoted, as indicated in FIGS. 8, 9 and 16. The other end of the link 235 is pivoted to the end of the arm 236 by the pivot 232. The arm 236 is pinned or otherwise fixedly secured to the outer end of the cutter-drive shaft 237 which is slidably mounted in and keyed to the sleeve 238. The sleeve 238 is journalled in the bearing-sleeve 239 mounted in the printer-frame-portion **133-*c*. The outer reduced-diametered end of the drive-shaft 237 passes through a clearance-hole in the vertical cutter-assembly block 207 (FIG. 16**).

An arm 240 is clampingly mounted on the outer end of the sleeve 238 by means of its split-collar embracing the sleeve 238 and tigthened thereon by a screw, as indicated in FIGS. 8, 9, 16 and 17. The lower end of the arm 240 carries a pin 241 which is adapted to nest in the upwardly-open notch 242 when the latter is raised by the lever 250 with its position shown in FIGS. 8 and 9 and which becomes free of the link 243 when the latter is lowered by the lever 250. The cutter-drive-link 243 has its rear end pivoted at 244 to the upper end of the cam-follower-lever 245, whose lower end is pivoted at 246 to the printer-frame **133-*c*. The lever 245 caries the cam-follower-roller 247 which bears against the outer surface of the cutter-cam 248 on the main shaft 20 and is held in contact therewith by the spring 249 whose one end is secured to the lever 245 and whose other end is anchored to the frame. The front end of the cutter-drive-link to 243 is optionally raised or lowered by means of lever 250 which is pivoted to the frame at 251 and carrying a roller 252 which rides in the arcuate slot 253 in the drive-link 243. By rising the outer end of the lever 250, the drive-link 243 is raised so that the notch 242 thereof operatively inter-engages with the pin 241, causing thereby the drive-link 243 to actuate the cutter-linkae (24, 236, 235, 224) and the movable knife (226). When the lever 250 is lowered, the notch 242 thereof is disengaged from the pin 241 and the cutter is rendered inoperative. The retracted position of knife is adjusted by adjusting the split-collar (of arm 240) on the sleeve 238.**

A tension spring 255 is operatively interposed between the arm 240 and the stationary spring-anchorage 256, so as to pull the arm 240 against stop 257 carried by the adjustable plate 258, whereby the position of the stop 257 may be adjusted so as to align the pin 241 with the notch 242.

A conventional single-revolution clutch 261 (shown in FIGS. 4, 6, 19, and 37) is mounted on the main shaft 20. The trip-lever 262 of the clutch 261 is pivoted on the vertical pivot 263 and is operated through the forwardly-extending lever 264 thereof. To the outer end 265 of the lever 264 the right-hand end the cycle-bar 266 is pivoted. The left-hand end of the cycle-bar 266 is pivoted at 267 to the outer end of a support-lever 268 which is pivoted at 269, thereby supporting the cycle-bar 266 for a straightline lateral movement (the lengths of arms or levers 264 and 268 being equal).

The cycle-bar carries a knob 270, by which the clutch 261 may be operated manually, by moving the knob 270 momentarily to the left, thereby obtaining a single label, ticket or tag. By manually keeping the knob 270 to the left, any number of labels, tickets or tags can be delivered.

The cycle-bar 266 has a vertical cam-plate 271 at the left end thereof. The right-hand edge 272 of the cam-plate is adapted to be engaged by the trip-lever 273 of the counter 180 whenever the counter is set for a desired number of labels, tickets or tags, until the selected number thereof has been printed and paid out by the machine. In order to govern or control the clutch by means of the counter 180, the counter is set by means of its units dial 275, its tens dial 276 and its hundreds dial 277 to the desired count, and then the cycle-bar 266 is moved manually to the left until the trip-lever 273 of the counter 180 rides up over the left-hand edge of the cam-plate 271 and drops onto the right-hand edge 272 thereof and thereby keeps the cycle-bar from moving to the right until the desired count has been reached.

Figure 13:
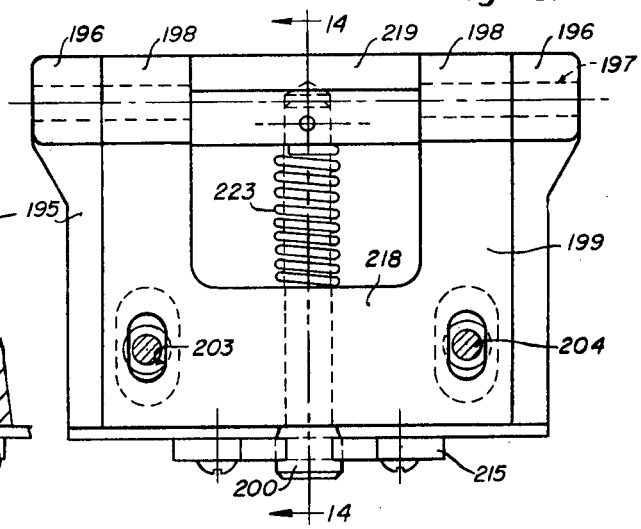
FIG. 13 represents a rear elevational view of printer-head-mounting member secured to the front end of the printer-arm, viewed on line 13—13 of FIG. 12, and shown on a larger scale.
Figure 13:
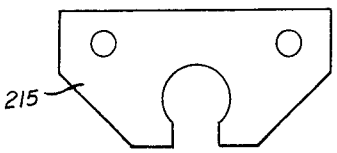

The printer-head 195 is pivoted on a removeable pivot-pin 197 which extends through the rearwardly extending pivot-ears 196 of the printer-head at 195 and through the similarly rearwardly extending pivot-ears 198 of the printer-head-mounting member 199. The printer-head-mounting member 199 is secured to the front vertical face of the printer-arm 131 by means of the headed screws 204 which extends through vertically elongated slots in the member 199, so that the member may be vertically adjusted in relation to the printer-arm 131. The heads of the screws 204 nest in correspondingly elongated recesses surrounding the screw-holes, as indicated in FIGS. 8, 12 and 13.

A latch-plunger or rod 205 is slidably mounted in a vertical hole 206 in the central portion 218 of the printing-head-mounting member 199, and has a press-bar 219 secured to its upper end. A compression spring 223 is mounted on the latch-rod 205 between the press-bar 219 and the upper surface of the central portion 218 of the printer-head-mounting member 199. A latching-head 200 is provided on the lower end of the latch-rod 205.

A latch-plate or keeper-plate 215 is secured to the bottom of the printer-head 195 by screws (as indicated in FIGS. 8, 12, 13 and 14). The keeper-plate 215 has a keyhole-shape opening therein as indicated in FIG. 13A. The rear straight portion of the keyhole is open rearwardly and is of a width just sufficient to permit the main body of the latch-rod 205 to pass through it, while the front circular portion of the keyhole is just sufficiently large to permit the round head 200 of the latch-rod 205 to nest therein with a nest fit. By nesting the head 200 in the front round part of the keyhole, the lower portion of the printer-head 195 is firmly latched to the lower portion of the mounting member 199 while the upper portion of the printer-head 195 is retained on the pivot 197. To detach the printer-head, it is only necessary to depress the bar 219 sufficiently to place the head 200 of the latch-rod 205 below the latch-plate 215, whereupon the printer-head 195 can be swung outwardly or forwardly (about the pivot 197). While so swung forwardly, the pivot 197 is pulled out, thereby completely detaching the printer-head 195 from the mounting member 199. By the reverse sequence of operations, the printer-head 195 can be re-attached to the mounting member 199. A band printer head may be similarly mounted to the mounting member for ready attachment thereto a detachment therefrom.

Figure 35:
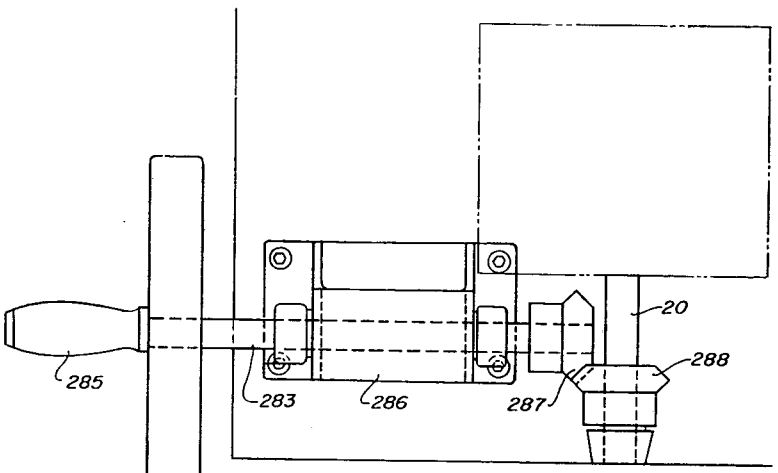
FIG. 35 represents a top plan view of the same.
Figure 34:
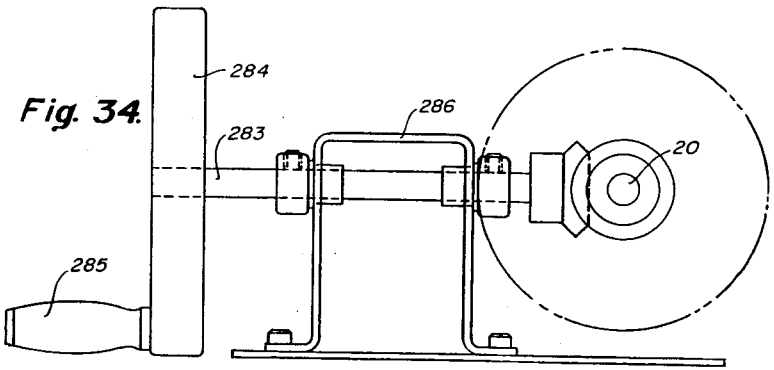
FIG. 34 represents a right side elevational view of a modified form of machine-drive, for manually driving the machine.
Figure 36:
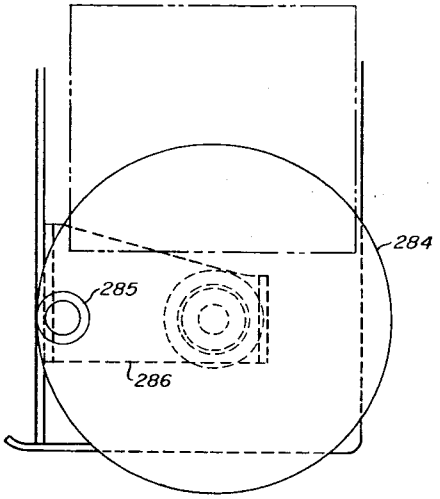
FIG. 36 represents a front elevational view of the same.
Figure 19:
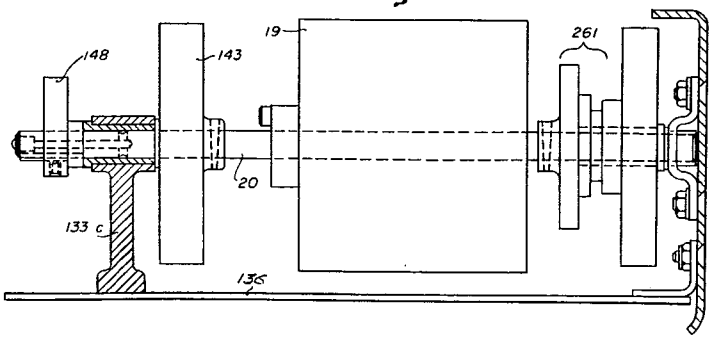
FIG. 19 represents a front elevational view of the main shaft and of the cams and brake thereon.

FIG. 34, 35 and 36 illustrate a modified embodiment or variant use of the machine of the present, in which the machine can be operated mutually. In such case the start-and-stop switch 280 is removed from the front-panel 281, and through the empty switch-mounting hole in the front panel 281 the operating-shaft 283 is extended. A hand-wheel 284, having a handle 285 thereon is mounted on the outer end of the mutually-operated shaft 283, in front of the front panel 281. The shaft 283 is journaled in the bracket 286, and on its inner end a beveled gear 287 is mounted, which meshes with a corresponding beveled gear 288 mounted on the mainshaft 20.

While in the following claims reference is made only to a ticket or to tickets, it should be understood that by such reference it is intended to also encompass labels and tags.

As used in the following claims, the word "kinds" in the phrase "different kinds of tickets" is intended to encompass tickets of different lengths and/or widths and also tickets, tags and labels otherwise differing from each other as, for instance, as to the presence or absence of adhesive thereon and as to the kind of adhesive thereon, such as, for instance, pressure-sensitive adhesive or thermoplastic adhesive or mucilage type of adhesive, and as, for instance, whether the pressure-sensitive labels are mounted on a tape of release-paper from which they are later peeled, or whether the ticket are adhesive-free pin-tickets or adhesive-free tickets arranged to be otherwise applied to the goods or whether the tags are string-tags or button-engaging hangtags, or adhesive-free tickets, tags or labels, arranged to be otherwise applied to the goods, and as to the presence or absence of notches, holes or perforations in the tape of which ticket, tag or label is made or as to the kind of paper stock or other stock of which the tickets, tags or labels are formed. All such different kinds of tickets, tags and labels are well known in the art. The phrase "type-holder" as used in the following claims is intended to encompass both the printer-head 195 with its type-chase 202 as well as the prior-art band type printer preferred to above and their equivalents.

Having illustrated and described an embodiment of our invention, we claim the following.

1. A unitary ticket-supply-and-feeder magazine for optionally holding a supply of any one of several different kinds of tickets and for intermittently feeding tickets from said supply and for interchangeable attachment to and detachment from a unitary cyclical ticket-printer having a print-impression platen and having a type-holder carrying printing-type-elements for imprinting the desired printed matter on successive tickets and having cyclical type-pressing means for pressing the printing-type and the print-impression platen towards each other so as to imprint tickets successively disposed between the printing-type and the print-impression platen and for separating the printing-type and the print-impression platen from each other after each imprinting and having mechanical ticket-feeder drive-means for driving the ticket-feeder of the magazine in synchronism with the cycles of the ticket-printer when the magazine is attached to the ticket-printer, said type-pressing means and ticket-feeder drive-means of the ticket-printer not being removed from but remaining a part of the ticket-printer when the magazine is detached from the ticket-printer, said magazine including a ticket-supply-holder and ticket-feeder-means including reciprocable ticket-advancing means arranged to advance a ticket from the ticket-supply-holder towards the print-impression platen of the ticket-printer and including means for selectively accommodating different kinds of tickets, and said ticket-advancing means including a driven member arranged mechanicaly to interengage with the ticket-feeder drive-means of the ticket-printer when the magazine is attached to the ticket-printer, whereby said ticket-feeder drive-means of the ticket-printer is adapted to cause the ticket-feeder of the magazine intermittently to feed tickets from the ticket-supply-holder of the magazine to the ticket-printer in synchronism with the cycles of the ticket-printer, whereby the ticket-printer may be caused optionally to print different kinds of tickets by attaching thereto the magazine loaded with the particular kind of ticket to be imprinted.

2. A ticket supply and feeder magazine according to claim 1, including means for longitudinally adjusting the location of the tickets fed thereby in relation to the print-impression platen of the ticket-printer, in a direction parallel to the travel-path of the tickets.

3. A ticket supply and feeder magazine according to claim 2, in which the ticket-feeder of the magazine includes ticket-guiding means defining a ticket-travel-path, and means for adjusting said ticket-guiding means transversely of the ticket-travel-path for aligning the tickets with the print-impression platen of the ticket-printer.

4. A ticket supply and feeder magazine according to claim 1, including means for causing the ticket-feeder-means to be so located in relation to the print-impression platen of the ticket-printer when the magazine is detached from the ticket-printer that the driven member of the ticket-feeder-means will be positioned for a co-operative engagement by the ticket-feeder drive-means of the ticket-printer when the magazine is re-attached to the ticket-printer.

5. A ticket supply and feeder magazine according to claim 4, in which the ticket-feeder of the magazine includes ticket-guiding means defining a ticket-travel-path, and means for adjusting said ticket-guiding means transversely of the ticket-travel-path for aligning the tickets with the print-impression platen of the ticket-printer.

6. A unitary ticket-supply-and-feeder magazine for selectively accommodating different kinds of tickets and for interchangeable attachment to and detachment from a unitary cyclical ticket-printer having a print-impression platen and having a type-holder and having cyclical type-pressing means for pressing the printing-type carried by the type-holder and the print-impression platen towards each other so as to imprint tickets successively disposed between the printing-type and the print-impression platen and for separating the print-impression type and the print-impression platen from each other after each imprinting and having tape-feeder drive-means, said magazine including a ticket-tape-roll-holder and a tape-feeder having a tape-bed extending from said tape-roll-holder, on which tape-bed the tape is adapted to travel from the tape-holder to the print-impression platen of the ticket-printer, said tape-feeder including means for engaging the tape and intermittently moving successive ticket-lengths thereof on said tape-bed to the print-impression platen during non-printing portions of the cycles of the ticket-printer, said type-pressing means and ticket-feeder drive-means of said ticket-printer not being removed from but remaining a part of the ticket-printer when the magazine is detached from the ticket-printer, said ticket-tape-roll-holder and tape-feeder of the magazine being arranged selectively to accommodate different kinds of tickets, and said tape-feeder including a driven member associated with said tape-engaging means and adapted to be mechanically interengaged with the tape-feeder drive-means of the ticket-printer when the magazine is attached thereto, thereby to cause said tape-engaging means of the tape-feeder to feed tickets to the ticket-printer during non-printing portions of the cycles of the ticket-printer, whereby the ticket-printer may be caused optionally to print different kinds of tickets by attaching thereto the magazine loaded with the particular kind of ticket to be imprinted.

7. A unitary ticket-supply-and-feeder magazine for selectively accommodating different kinds of tickets and for interchangeable attachment to and detachment from a unitary cyclical ticket-printer having a print-impression platen and having a type-holder and having cyclical type-pressing means for pressing the printing-type and the print-impression platen towards each other so as to imprint tickets successively disposed between the printing-type and the print-impression platen and for separating the printing-impression type and the print-impression platen from each other after each imprinting and having tape-feeder drive-means, said type-pressing means and ticket-feeder drive-means of the ticket-printer not being removed from but remaining a part of the ticket-printer when the magazine is detached from the ticket-printer, said magazine including a ticket-tape-roll-holder and a tape-feeder having a tape-bed extending from said tape-roll-holder, on which tape-bed the tape is adapted to travel from the tape-roll-holder to the print-impression platen of the ticket-printer, said tape-feeder including a shuttle adjacent said tape-bed and reciprocable to-and-fro in a direction parallel with the travel-path of a tape on said tape-bed, a tape-feeder-finger carried by said shuttle in operative juxtaposition to the tape on said tape-bed, said tape-feeder including a driven member associated with said shuttle and adapted to be operatively interengaged with the tape-feeder drive-means of the ticket-printer when the magazine is attached to the ticket-printer, whereby said tape-feeder drive-means is adapted to reciprocate said shuttle so as intermittently to feed successive ticket-lengths of the tape to the print-impression platen of the ticket-printer in synchronism with the printing cycles thereof, whereby the ticket-printer may be caused optionally to print different kinds of tickets by attaching thereto the magazine loaded with the particular kind of ticket to be imprinted.

8. A ticket supply and feeder magazine according to claim 7, including means for adjusting the location of the feeder-finger in relation to the shuttle in a direction parallel to the tape-feed path.

9. A ticket supply and feeder magazine according to claim 8, including means for guiding the tape on the tape-bed so as to define the travel-path of the tape over said tape-bed, and means for adjusting the location of said tape-guide means tranversely of the tape-travel path.

10. A ticket supply and feeder magazine according to claim 7, including means for guiding the tape on the tape-bed so as to define the travel-path of the tape over said tape-bed, and means for adjusting the location of said tape-guide means transversely of the tape-travel path.

11. A ticket supply and feed magazine according to claim 7, including means for causing the shuttle to be so located in relation to the tape-bed when the magazine is detached from the ticket-printer that the aforementioned driven member of the tape-feeder will be position for its operative engagement by the tape-feed drive-means when the magazine is re-attached to the ticket-printer.

12. A unitary ticket-supply-and-feeder magazine for optionally holding a supply of any one of several different kinds of tickets and for feeding tickets from said supply and for interchangeable attachment to and detachment from a unitary cyclical ticket-printer having mechanical ticket-feeder drive-means for mechanically driving the ticket-feeder of the magazine when the magazine is attached to the ticket-printer, said magazine including a ticket-supply-holder and ticket-feeder-means arranged optionally to hold a supply of any one of several different kinds of tickets and to feed tickets from such supply to the printer, said ticket-feeder-means including ticket-advancing means arranged to advance a ticket from the ticket-supply-holder to the ticket-printer when the magazine is attached to the printer, and said ticket-advancing means including a mechanical driven-member arranged to be mechanically interengaged with the ticket-feeder drive-means of the ticket-printer when the magazine is attached to the printer so as to cause the ticket-feeder of the magazine to feed tickets from the ticket-supply-holder of the magazine to the ticket-printer during non-printing portions of the cycles of the ticket-printer, whereby the ticket-printer may be caused optionally to print a supply of any one of several different kinds of tickets by attaching thereto the magazine loaded with the particular kind of ticket to be imprinted.

* * * * *